US011462370B2

(12) United States Patent
Nakamura

(10) Patent No.: US 11,462,370 B2
(45) Date of Patent: Oct. 4, 2022

(54) PUSH SWITCH

(71) Applicant: Tetsuya Nakamura, Tokyo (JP)

(72) Inventor: Tetsuya Nakamura, Tokyo (JP)

(73) Assignee: MITSUMI ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 17/407,057

(22) Filed: Aug. 19, 2021

(65) Prior Publication Data

US 2022/0076902 A1 Mar. 10, 2022

(30) Foreign Application Priority Data

Sep. 4, 2020 (JP) ..... JP2020-148991

(51) Int. Cl.

| | |
|---|---|
| ***H01H 13/04*** | (2006.01) |
| ***H01H 13/14*** | (2006.01) |
| ***H01H 13/10*** | (2006.01) |
| *H01H 13/06* | (2006.01) |

(52) U.S. Cl.

CPC ..... *H01H 13/14* (2013.01); *H01H 13/10* (2013.01); *H01H 13/063* (2013.01)

(58) Field of Classification Search

CPC ..... H01H 3/125; H01H 13/705; H01H 13/14; H01H 13/04; H01H 13/10; H01H 13/70; H01H 13/704; H01H 13/7065; H01H 13/7006; H01H 13/7057; H01H 13/78; H01H 13/79; H01H 13/52; H01H 13/703; H01H 13/507; H01H 3/12; H01H 13/20

See application file for complete search history.

(56) References Cited

U.S. PATENT DOCUMENTS

2004/0231968 A1* 11/2004 Yu ..... H01H 13/48 200/402
2009/0201655 A1* 8/2009 Watanabe ..... H01H 13/48 200/341
2009/0266698 A1* 10/2009 Kikuchi ..... H01H 13/52 200/341

FOREIGN PATENT DOCUMENTS

JP 2011113652 A 6/2011

* cited by examiner

*Primary Examiner* — Ahmed M Saeed
(74) *Attorney, Agent, or Firm* — McCoy Russell LLP

(57) ABSTRACT

The push switch 1 includes a case 2, a pair of contacts 3 and 4, a movable contact 5, a cap 7 covering the case 2 from the upper side, and a cover 8 pressing the cap 7 from the upper side. The cover 8 includes a top plate 81 and a pair of extending portions 83 extending downward from opposite sides of the top plate 81. Each of the extending portions 83 of the cover 8 has a pair of leg portions 831 extending downward and a bridge portion 832 connecting the pair of leg portions 831. The bridge portion 832 has a pair of inclined portions 8321 formed at the lower end portion of the bridge portion 832 and inclined outward, and a cutout portion 8322 formed between the pair of inclined portions 8321.

10 Claims, 18 Drawing Sheets

PUSH SWITCH

CROSS-REFERENCE TO RELATED APPLICATION

The present application claims priority to Japanese Patent Application No. 2020-148991 filed on Sep. 4, 2020. The entire content of the above-listed application is hereby incorporated by reference for all purposes.

TECHNICAL FIELD

The present disclosure generally relates to push switches and, to a push switch that operates with a click feeling by a pressing operation of a user.

BACKGROUND

As operation buttons for various electronic equipment, push switches utilizing dome-shaped movable contacts are often employed. Such push switch can be miniaturized with a low height and can provide a good click feeling (pressing operation feeling) to the user when an operation button is operated by pressing of the user.

For example, Patent Document 1 discloses a push switch 500 as shown in FIGS. 1 and 2. FIG. 1 is an exploded perspective view of a push switch 500. FIG. 2 is a perspective view of the push switch 500. As shown in FIGS. 1 and 2, the push switch 500 includes a case 510 comprised of a substantially square bottom plate 511, four wall portions 512 extending upward from each side of the bottom plate 511, a containable portion 513 defined by the bottom plate 511 and the four wall portions 512, and engagement projections 514 respectively formed on a pair of the opposite wall portions 512 (a pair of wall portions extending in the Y direction in the drawing), a central contact 520 and an outer contact 530 provided on the bottom plate 511 spaced apart from each other, and a dome-shaped movable contact 540 provided above the central contact 520 and the outer contact 530 in the containable portion 513 of the case 510. The push switch further includes a pressing member 550 for covering the containable portion 513 of the case 510 from the upper side, wherein the pressing member 550 comprises a flat plate shaped base portion 551 formed of an elastic material and placed on the upper end of the four wall portions 512 of the case 510 and a protrusion 552 formed at a substantially center portion of the base portion 551 for pressing the dome-shaped movable contact 540 downward. The push switch further includes a cover 560 made of a metallic material for holding the pressing member 550 on the case 510 by pushing down the base portion 551 of the pressing member 550 from the upper side thereof.

The cover 560 includes a top plate 561 having a substantially square planar shape, a circular opening 562 formed at a substantially center of the top plate 561, and a pair of extending portions 563 extending downward from a pair of opposite sides (a pair of sides extending in the Y direction in the drawing) of the top plate 561. Each of the extending portions 563 has a pair of leg portions 5631 extending downward from the side of the top plate 561, and a bridge portion 5632 connecting the lower end portions of the leg portions 5631 to each other. Each bridge portion 5632 is inclined outward from the lower end portions of the leg portions 5631. Further, each of the engagement projections 514 of the case 510 has an inclined portion 5141 whose height gradually increases from an upper side toward a lower side, and a flat portion 5142 straight extending from the top of the inclined portion 5141 to the lower side.

The push switch 500 is assembled by mounting the cover 560 to the case 510 by pressing down the cover 560 from the upper side (+Z direction) to the case 510 in a state that the dome-shaped movable contact 540 is placed in the containable portion 513 of the case 510 and the base portion 551 of the pressing member 550 is placed on the upper end of the wall portions 512 of the case 510. When the cover 560 is attached to the case 510 from the upper side, the bridge portions 5632 of the pair of extending portions 563 of the cover 560 slide on the inclined portions 5141 of the engagement projections 514 of the case 510, respectively. As a result, the pair of extending portions 563 are opened outwardly, and thereby the cover 560 can be pushed downward (in the −Z direction). Thereafter, when the bridge portions 5632 pass through the flat portions 5142 of the pair of engagement projections 514 of the case 510, the lower surfaces of the flat portions 5142 engage with the upper surfaces of the bridge portions 5632, respectively. Thereby, the cover 560 is locked with respect to the case 510, and thus the push switch 500 is assembled.

As shown in FIG. 2, in a state that the push switch 500 is assembled, the protrusion 552 of the pressing member 550 is inserted through the opening 562 of the cover 560 to protrude upward from the top plate 561 of the cover 560. Furthermore, the cover 560 is locked with respect to the case 510, and the base portion 551 of the pressing member 550 is held in a compressed state between the top plate 561 and the upper end of the wall portions 512 of the case 510. Therefore, since the space between the case 510 and the cover 560 is sealed by the base portion 551, it is possible to prevent entry of dust and dirt into the containable portion 513 of the case 510. With such a configuration, the push switch 500 can realize a dust-proof function. The push switch 500 having such a dust-proof performance is suitable for use in an environment where many dust and dirt can be present. For example, such a push switch 500 may be used as a switch for an operation panel of a dashboard of an automobile.

As described above, in order to assemble the push switch 500 having the dust-proof function, it is necessary to compress the base portion 551 of the pressing member 550 between the upper end of the wall portions 512 of the case 510 and the top plate 561 of the cover 560 by pressing the cover 560 against the case 510 from the upper side, and lock the cover 560 with respect to the case 510 in this state. In order to facilitate attachment of the cover 560 to the case 510 from the upper side, the bridge portions 5632 of the pair of extending portions 563 of the cover 560 are inclined outward. When the cover 560 is pressed against the case 510 from the upper side, the bridge portions 5632 respectively slide on the inclined surfaces 5141 of the engagement projections 514 of the case 510, so that the extending portions 563 of the cover 560 can be opened outward. Therefore, the cover 560 can be easily attached to the case 510 from the upper side.

For this reason, it is necessary to incline the bridge portions 5632 of the extending portions 563 of the cover 560 outwardly. In order to incline each bridge portion 5632 outwardly, it is necessary to bend each of the bridge portions 5632 outwardly in the manufacturing process of the cover 560. As described above, since the push switch 500 is small and low in height, the cover 560 which is a part of the push switch 500 is also very small. The bending process for bending each of the bridge portions 5632 of the very small metal cover 560 outwardly is very difficult. When such a bending process is performed, the yield of manufacturing the cover 560 is reduced, and thus the manufacturing cost of the push switch 500 is increased due to the reduction of the yield.

RELATED ART DOCUMENT

Patent Document

JP 2011-113652A

SUMMARY

Problems to be Solved by the Invention

The present disclosure has been made in view of the problem mentioned above. Therefore, it is an object of the present disclosure to provide a push switch in which it is possible to reduce the degree of difficulty of bending bridge portions of a pair of extending portions of a cover.

Means for Solving the Problems

The above object is achieved by the present disclosure defined in the following (1) to (10).

(1) A push switch, comprising:

a case having a containable portion defined by a bottom plate and a plurality of walls extending from the bottom plate toward an upper side;

a pair of contacts spaced apart from each other on the bottom plate in the containable portion;

a movable contact disposed above the pair of contacts in the containable portion and displaceable between a first position in which the pair of contacts are in a non-conductive state and a second position in which the pair of contacts are in a conductive state;

a cap covering the containable portion of the case from the upper side and including a flat plate-like base portion placed on an upper end of the plurality of walls of the case and a protrusion protruding from the base portion toward the upper side; and a cover engaging with the cap for holding the cap on the case, the cover including:

a top plate having a generally square planar shape, an opening formed in the top plate to allow the protrusion of the cap to pass therethrough, and a pair of extending portions respectively extending from opposite sides of the top plate toward a upper side, wherein the case includes a pair of engagement projections respectively formed on outer surfaces of a pair of wall portions among the plurality of wall portions, wherein each of the pair of extending portions of the cover has a pair of leg portions extending from the side of the top plate toward a lower side and a bridge portion connecting the pair of leg portions, wherein each bridge portion has a pair of inclined portions formed on a lower end portion of the bridge portion and inclined outward and a cutout portion formed between the pair of inclined portions, and wherein the cover is locked with respect to the case and holds the cap on the case when the pair of engagement projections respectively formed on the pair of opposite wall portions of the case are engaged with the bridge portions of the pair of extending portions of the cover.

(2) The push switch according to the above (1), wherein the pair of inclined portions are located below the pair of engagement projections, respectively.

(3) The push switch according to the above (1) or (2), wherein the pair of inclined portions are separated from each other by the cutout portion.

(4) The push switch according to any one of the above (1) to (3), wherein each of the bridge portions further includes an upwardly extending portion located on an upper side of the cutout portion, the upwardly extending portion being located between the pair of leg portions, and the pair of engagement projections are held between the pair of leg portions and the upwardly extending portion of the bridge portion.

(5) The push switch according to the above (4), wherein the upwardly extending portion has a shape corresponding to the shape of the cutout portion.

(6) The push switch according to any one of the above (1) to (5), wherein the pair of leg portions linearly extend downward from both end portions of the side of the top plate, and the distance between outer side surfaces of the pair of leg portions coincides with the length of the side of the top plate.

(7) The push switch according to the above (6), wherein each of the pair of leg portions has a straight portion in which an outer side surface and an inner side surface linearly extend downward and a reduced width portion in which an outer side surface linearly extends downward and an inner side surface inclines toward the outer side surface thereof, and the reduced width portion of each of the pair of leg portions is connected to the bridge portion.

(8) The push switch according to the above (7), wherein the outer side surfaces of the pair of engagement projections are in contact with the inner side surfaces of the pair of leg portions of each extending portion of the cover, respectively.

(9) The push switch according to any one of (6) to (8), wherein the outer side surfaces of the pair of engagement projections are located outside the opening of the cover in a planar view.

(10) The push switch according to any one of the above (1) to (9), wherein the cover further includes a bending portion extending downward from between the pair of leg portions, and the bending portion is separated from the pair of leg portions and the bridge portion.

Effects of the Invention

In the push switch of the present disclosure, since the cutout portion is formed in the lower end portion of the bridge portion of each of the pair of extending portions of the cover, the width of the lower end portion of the bridge portion which must be bent to form the inclined portions is limited. Therefore, the degree of difficulty of bendability for forming each inclined portion is reduced, and thus the yield of manufacturing the cover can be improved, and as a result, the manufacturing cost of the push switch can be reduced.

In addition, in the push switch of the present disclosure, a pair of engagement projections engaging with a pair of extending portions of the cover for locking the cover to the case are formed in the vicinity of both ends of the outer surface of each of the opposite wall portions of the case so as to be spaced apart from each other. Therefore, the inner side surfaces of the pair of extending portions of the cover and the outer side surfaces of the pair of engagement projections are in contact with each other at two positions in the vicinity of both ends on the respective outer side surfaces of the opposite wall portions of the case, so that the inclination of the cover with respect to the case is more effectively suppressed, and the attachment state of the cover with respect to the case can be stabilized.

DETAILED DESCRIPTION

Figure 1:
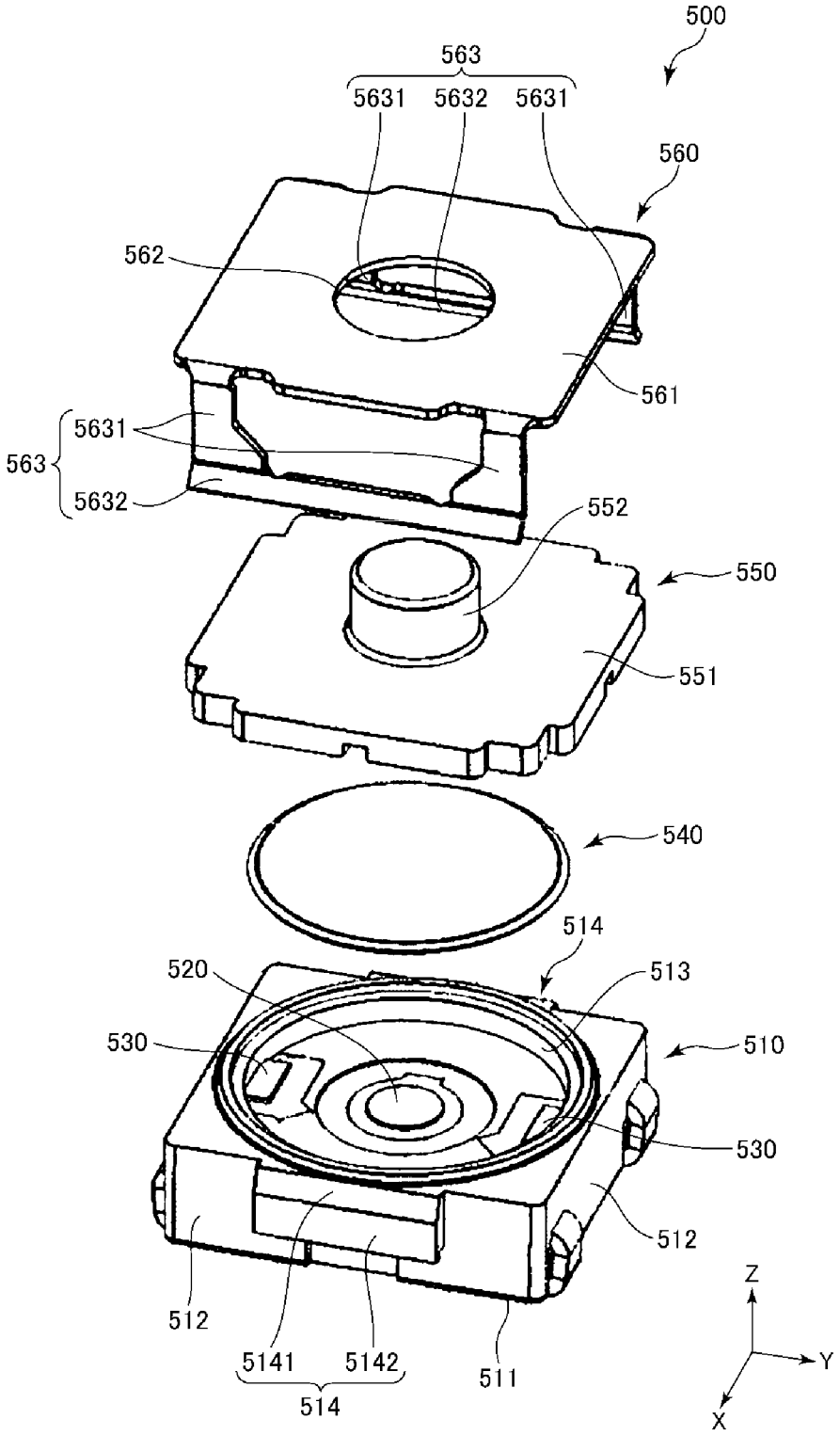
Prior art Fig. 1
FIG. 1 is an exploded perspective view of a push switch of a prior art.

Hereinafter, the push switch of the present disclosure will be described based on certain embodiments shown in the accompanying drawings. Note that each of the drawings referred to below is a schematic diagram prepared for explaining the present disclosure. The dimensions (length, width, thickness, etc.) of each component shown in the drawings do not necessarily reflect actual dimensions. In the drawings, the same or corresponding elements are denoted by the same reference numerals. In the following description, the positive direction of the Z-axis in each figure is sometimes referred to as "an upper side" and the negative direction of the Z-axis is sometimes referred to as "a lower side".

Figure 3:
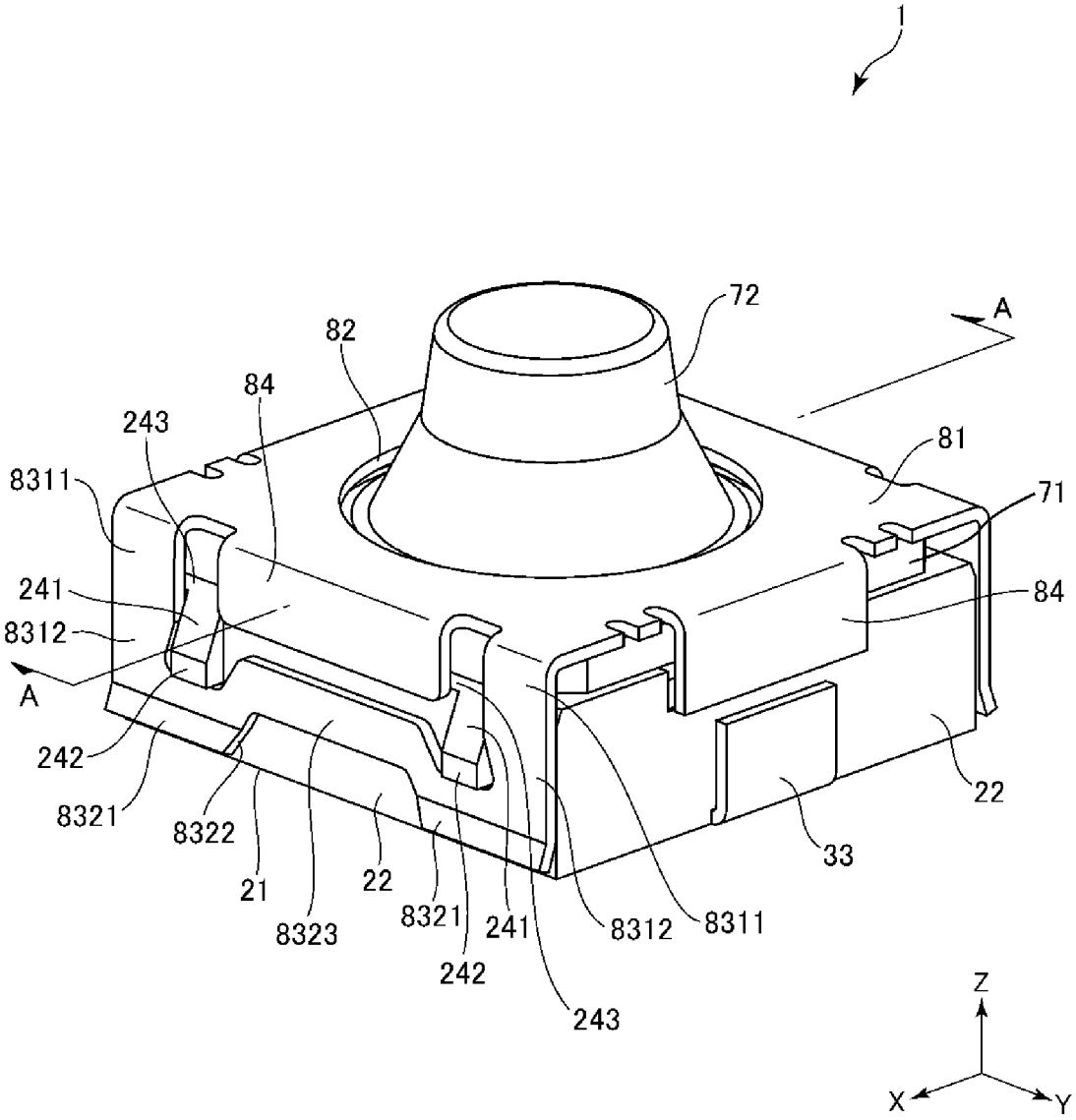
FIG. 3 is a perspective view of a push switch according to the present disclosure.
Figure 4:
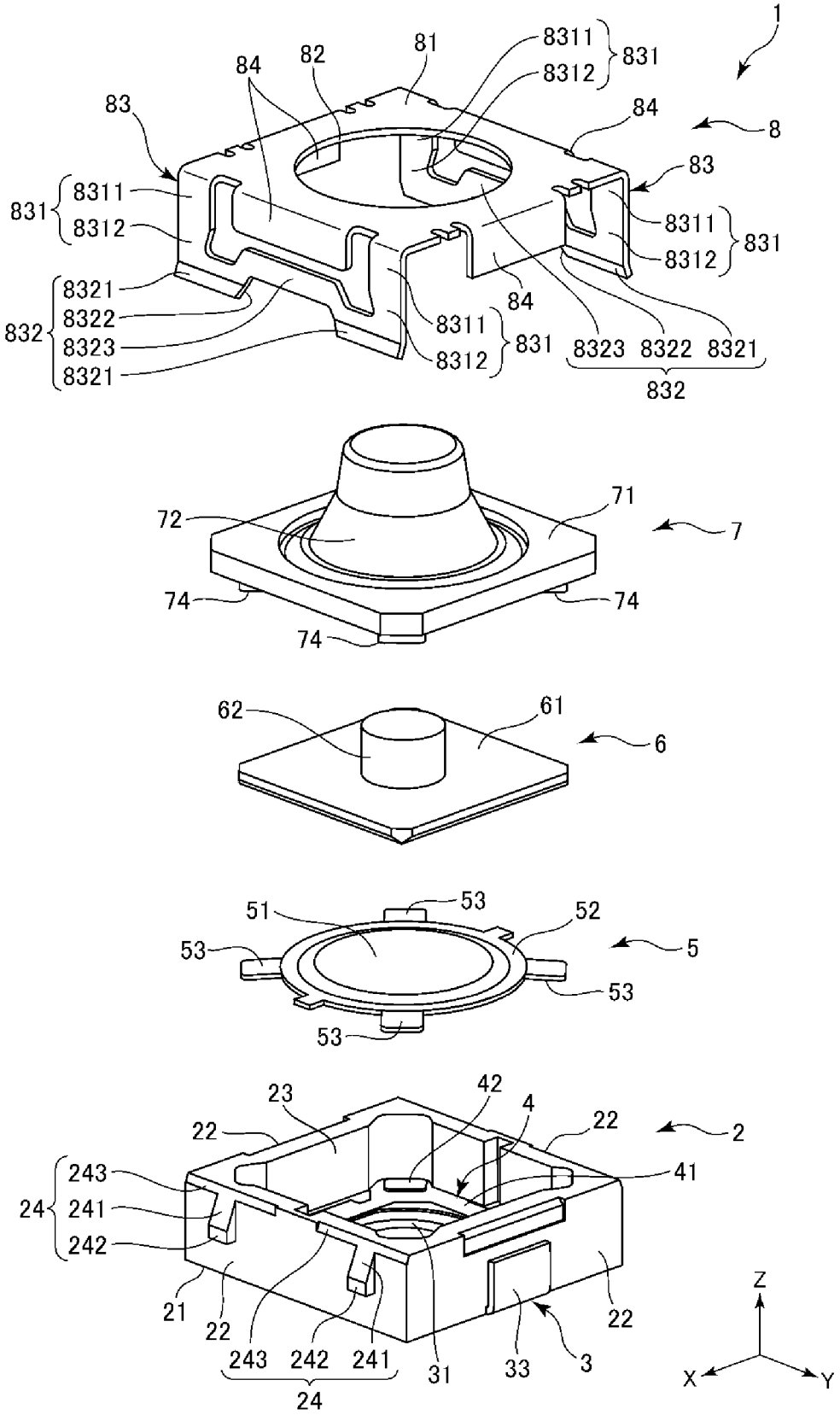
FIG. 4 is an exploded perspective view of the push switch shown in FIG. 3.
Figure 5:
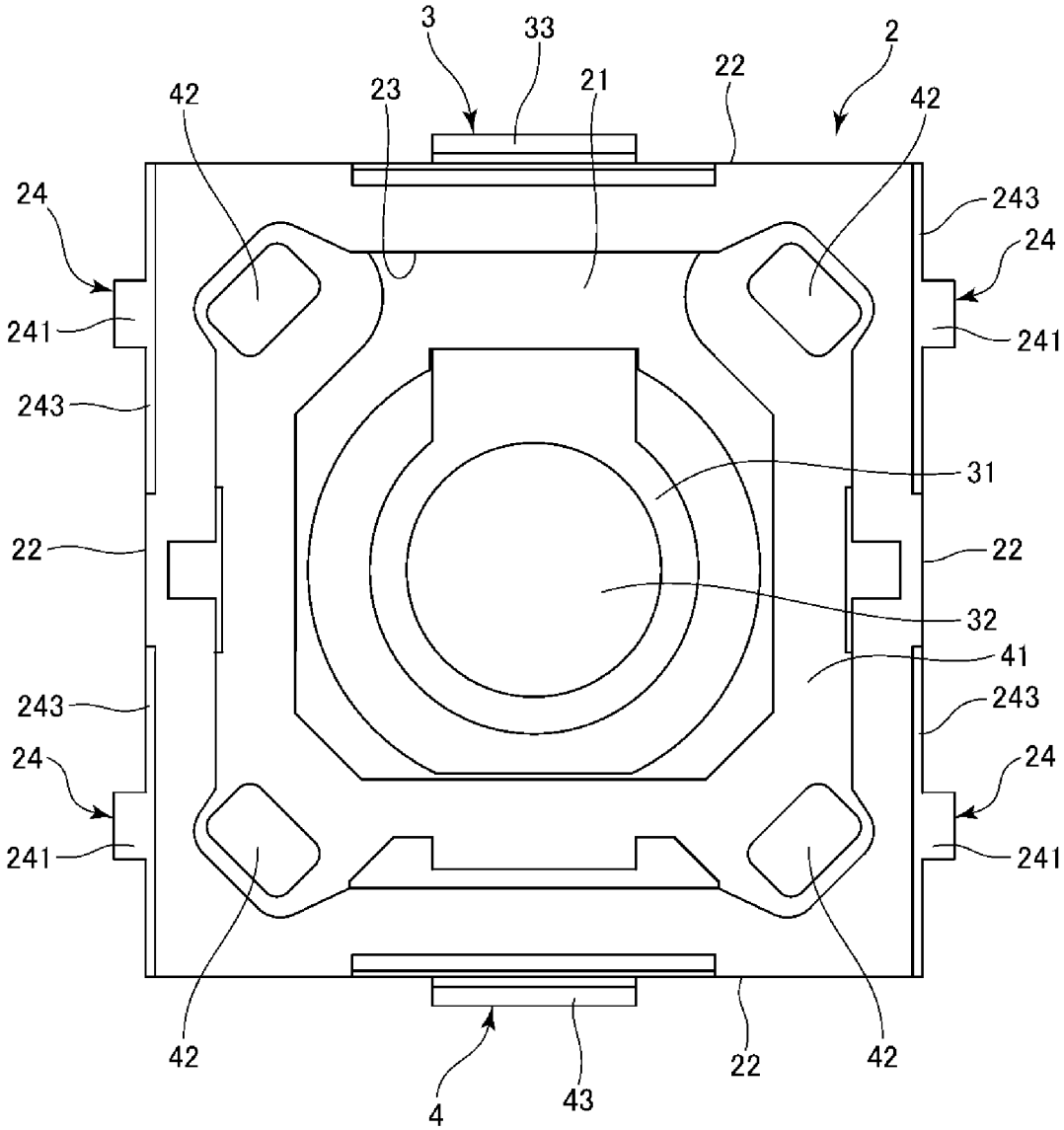
FIG. 5 is a top view of the case, the central contact, and the outer contact shown in FIG. 4.
Figure 5:
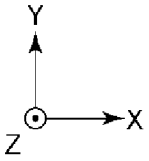
Figure 6:
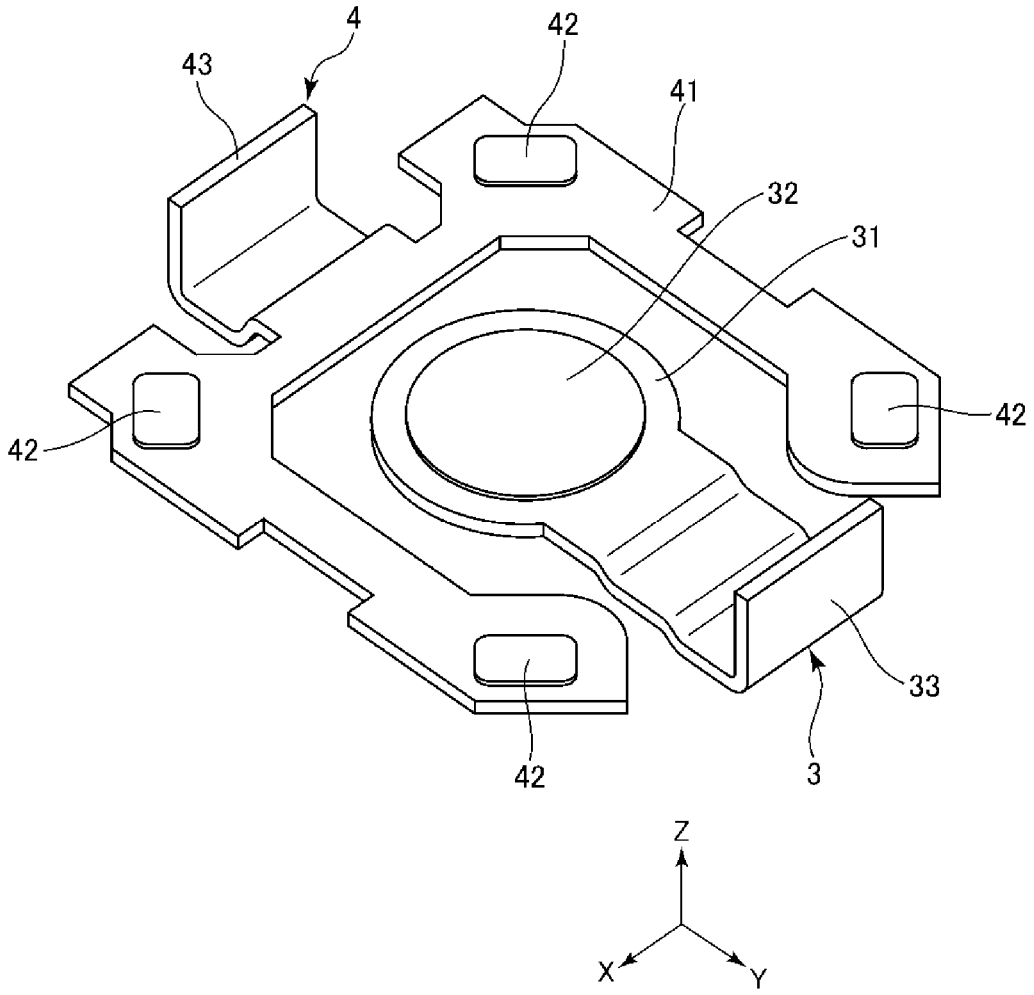
FIG. 6 is a perspective view of the central contact and the outer contact shown in FIG. 4.
Figure 7:
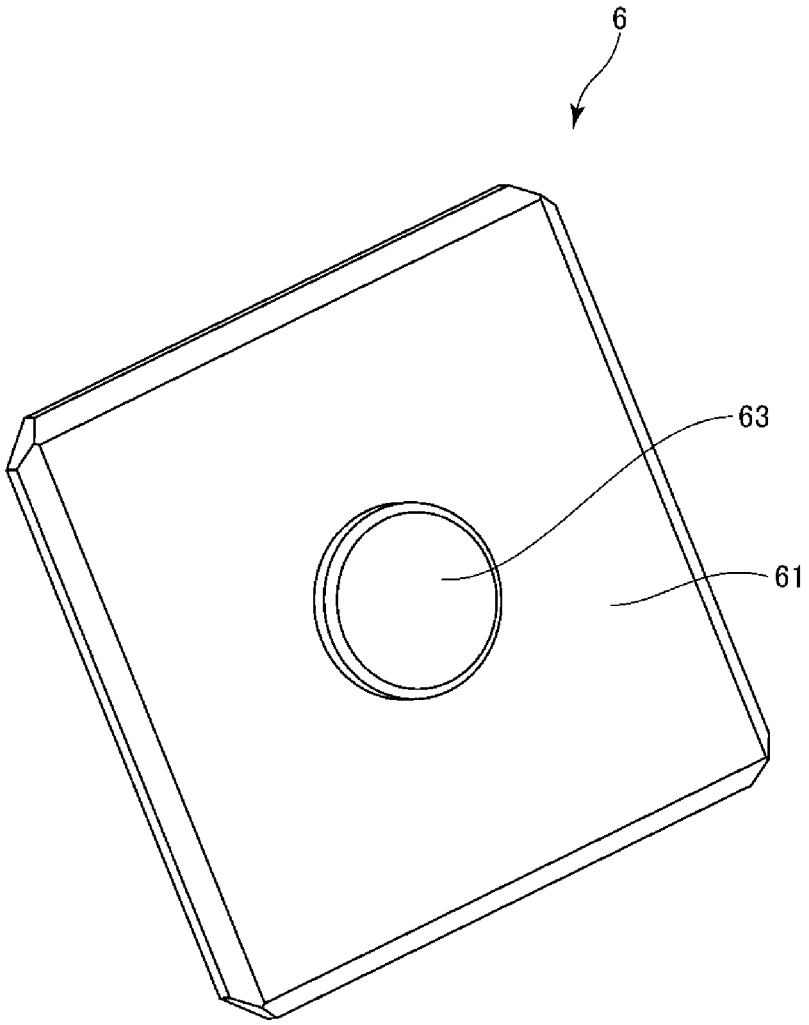
FIG. 7 is a perspective view of the pressing member shown in FIG. 4 viewed from another angle.
Figure 8:
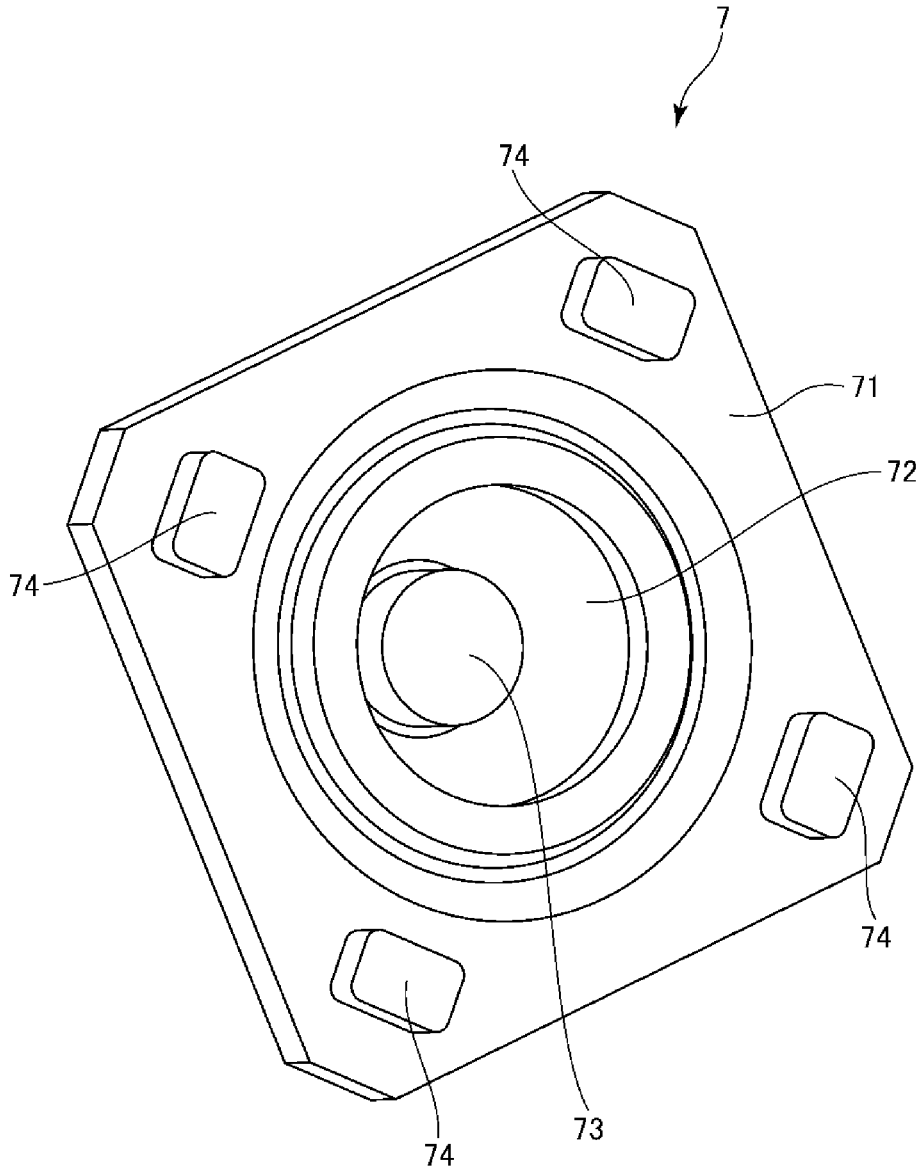
FIG. 8 is a perspective view of the cap shown in FIG. 4 viewed from another angle.
Figure 9:
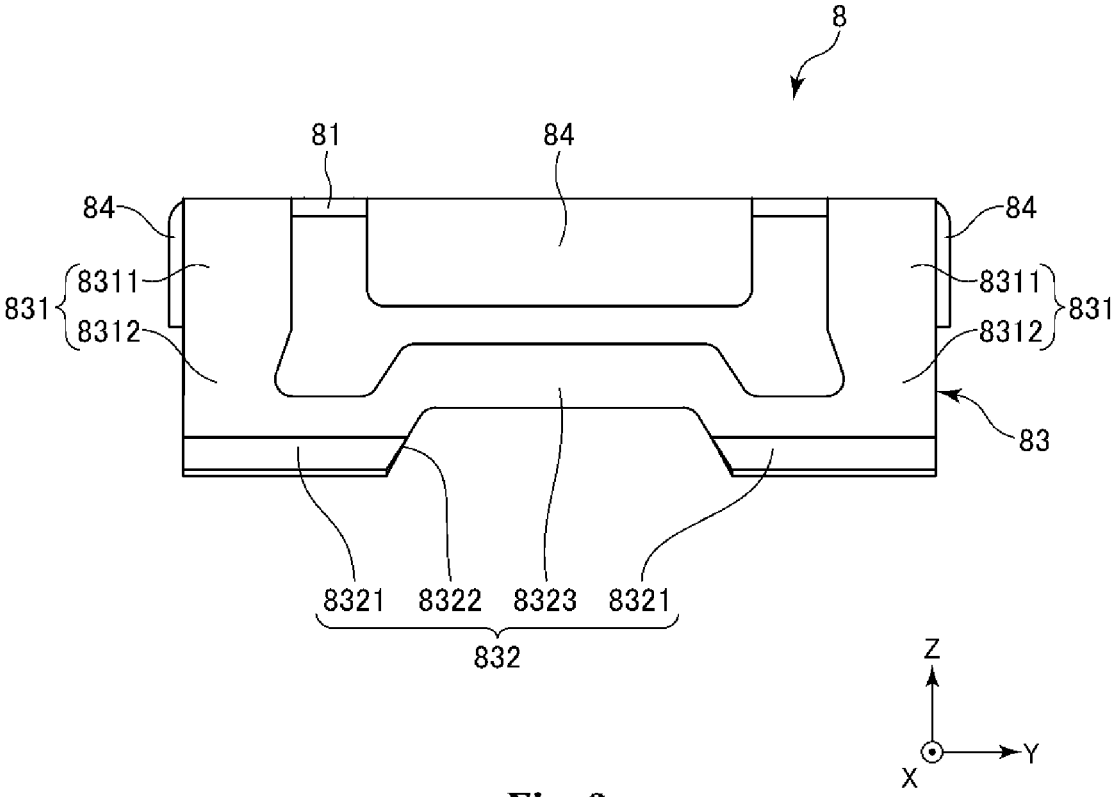
FIG. 9 is a view of the cover shown in FIG. 4 viewed from the X direction.
Figure 10:
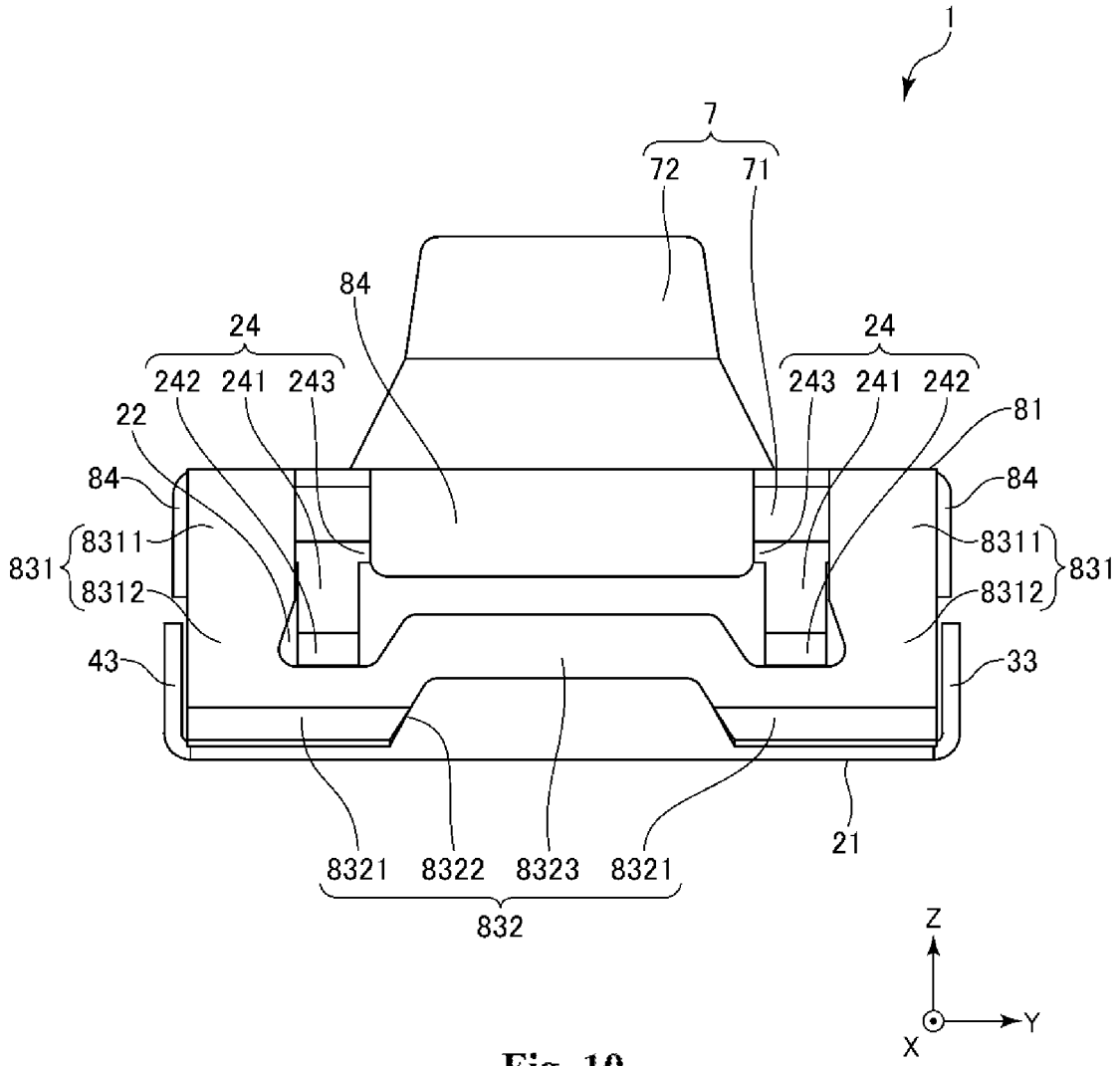
FIG. 10 is a view of the push switch shown in FIG. 3 viewed from the X direction.
Figure 11:
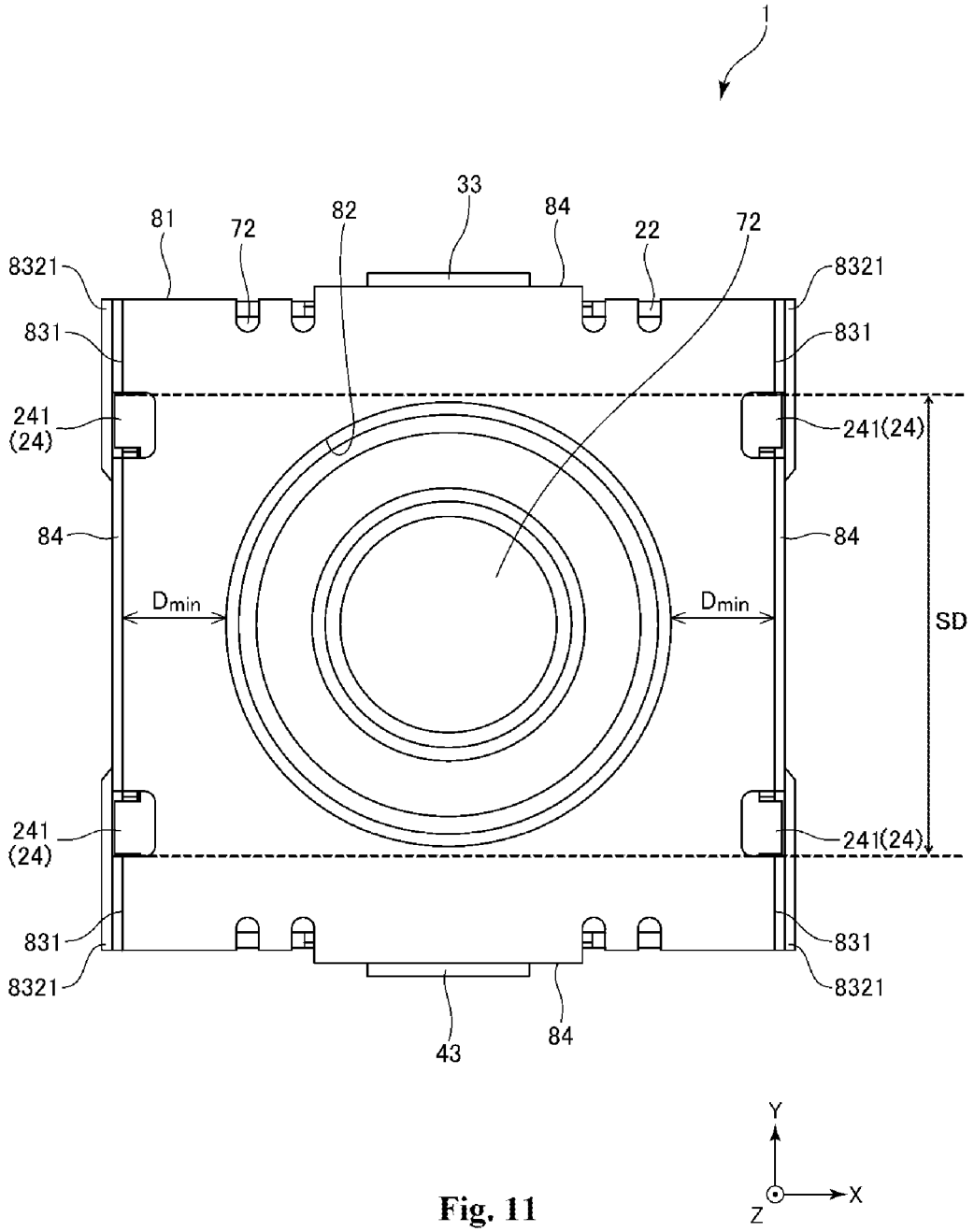
FIG. 11 is a view of the push switch shown in FIG. 3 viewed from the upper side.
Figure 12:
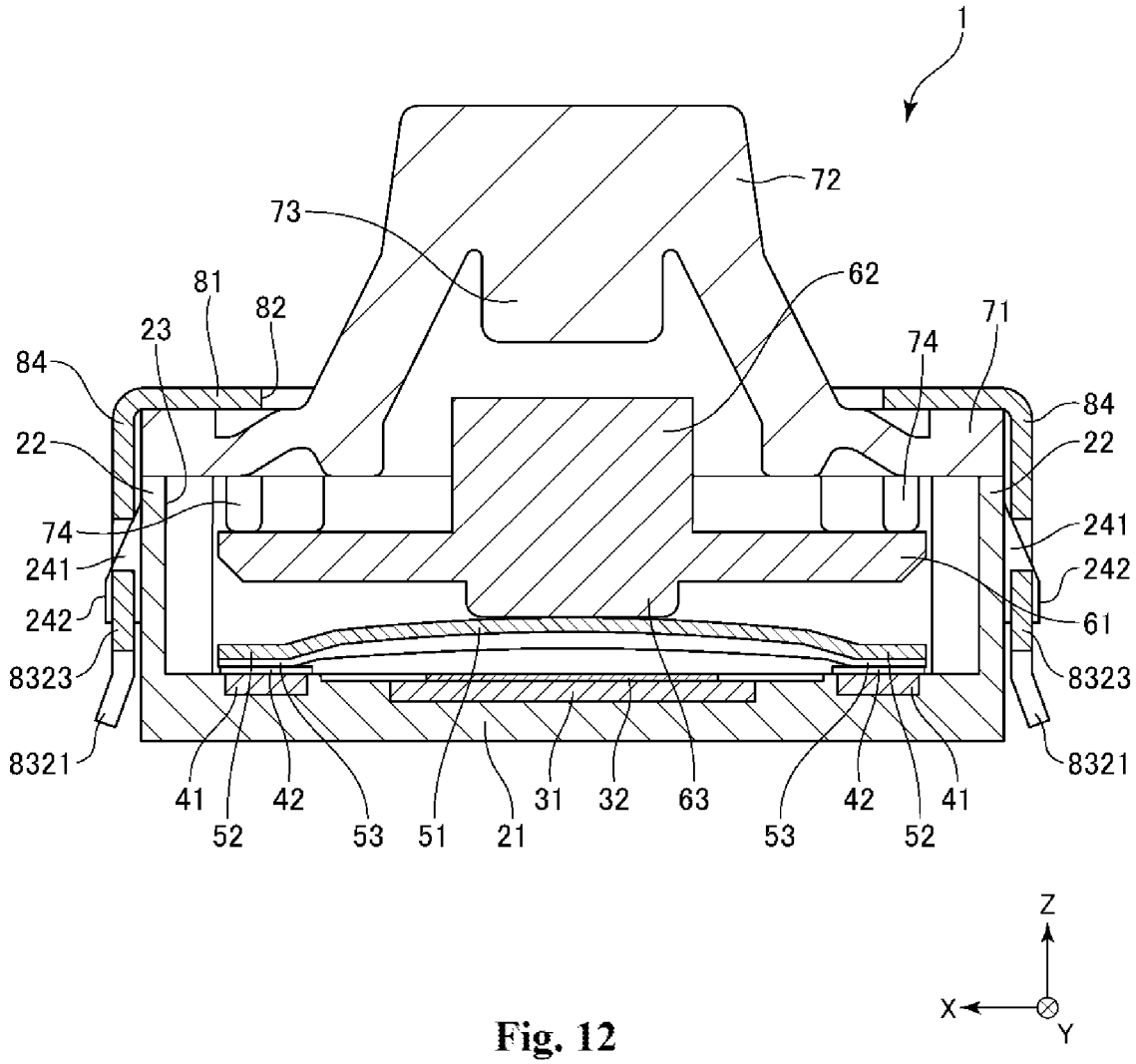
FIG. 12 is a longitudinal cross-sectional view of the push switch when the push switch shown in FIG. 3 is in a natural state.
Figure 13:
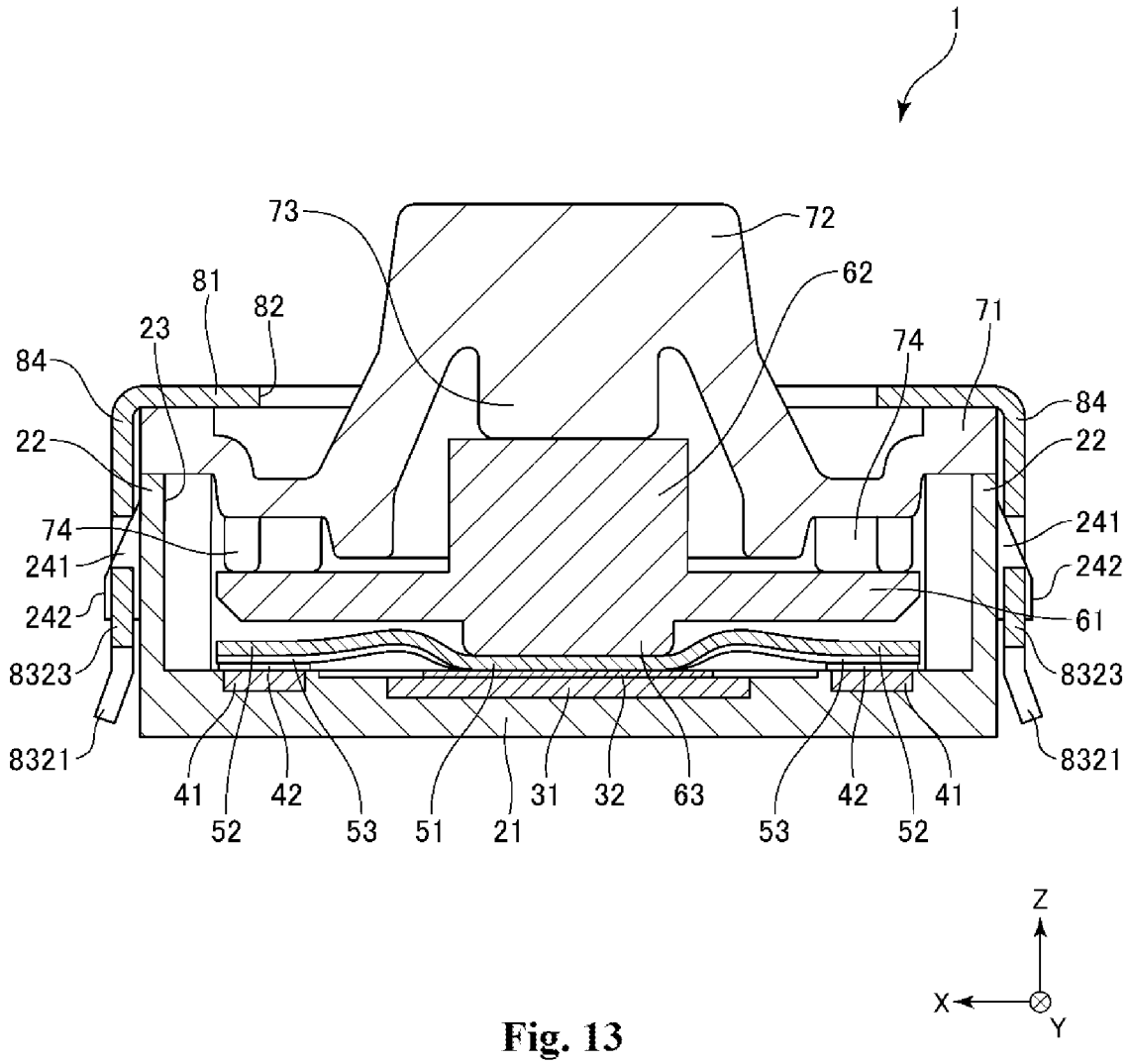
FIG. 13 is a longitudinal cross-sectional view of the push switch when the push switch shown in FIG. 3 is in a depressed state.

Hereinafter, the push switch of the present disclosure will be described in detail with reference to FIGS. 3 to 13. FIG. 3 is a perspective view of a push switch according to the present disclosure. FIG. 4 is an exploded perspective view of the push switch shown in FIG. 3. FIG. 5 is a top view of the case, the central contact, and the outer contact shown in FIG. 4. FIG. 6 is a perspective view of the central contact and the outer contact shown in FIG. 4. FIG. 7 is a perspective view of the pressing member shown in FIG. 4 viewed from another angle. FIG. 8 is a perspective view of the cap shown in FIG. 4 viewed from another angle. FIG. 9 is a view of the cover shown in FIG. 4 viewed from the X direction. FIG. 10 is a view of the push switch shown in FIG. 3 viewed from the X direction. FIG. 11 is a view of the push switch shown in FIG. 3 viewed from the upper side. FIG. 12 is a longitudinal cross-sectional view of the push switch when the push switch shown in FIG. 3 is in a natural state. FIG. 13 is a longitudinal cross-sectional view of the push switch when the push switch shown in FIG. 3 is in a depressed state.

The push switch 1 according to the embodiment of the present disclosure shown in FIG. 3 is a switch which is turned on when a pressing force exceeding the actuation force of the push switch 1 is applied by the user and which is turned off when the pressing force applied by the user is released. Further, since the push switch 1 has a dust-proof function, it is possible to prevent the entry of dust and dirt into the interior of the push switch 1. Therefore, the push switch 1 is suitable for use in an environment where many dust and dirt can be present. For example, the push switch 1 may be used as a switch for an operation panel of a dashboard in an automobile.

As shown in FIG. 3, the push switch 1 has a shape in which a protrusion to be pressed by a user protrudes upward from a low-height rectangular parallelepiped-shaped case. The push switch 1 has very small dimensions, for example about 6 mm (total length in the X direction)×about 6 mm (total length in the Y direction)×about 4 mm (total height from the bottom of the case to the top of the protrusion).

As shown in FIG. 4, the pushup switch 1 includes a case 2 having a containable portion 23 defined by a bottom plate 21 and a plurality of wall portions 22 extending from the bottom plate 21 upwardly; a central contact 3 and an outer contact 4 (a pair of contacts) provided on the bottom plate 21 in the containable portion 23 spaced apart from each other; a movable contact 5 disposed above the central contact 3 and the outer contact 4 in the containable portion 23 and displaceable between a first position (see FIG. 12) in which the central contact 3 and the outer contact 4 are in a non-conductive state and a second position (see FIG. 13) in which the central contact 3 and the outer contact 4 are in a conductive state; a pressing member 6 provided above the movable contact 5 in the containable portion 23 for displacing the movable contact 5 from the first position to the second position by pressing the movable contact 5 downward; a cap 7 covering the containable portion 23 from the upper side thereof and including a flat plate-like base portion 71 placed on the upper end of the plurality of wall portions 22 and a protrusion 72 formed at a substantial center of the base portion 71 so as to protrude from the base portion 71 toward the upper side thereof; and a cover 8 engaging with the case 2 for holding the cap 7 on the case 2 by pressing the base portion 71 from the upper side thereof, wherein the cover 8 includes a top plate 81 having a substantially square planner shape, an opening formed in the top plate 81 to allow the protrusion 72 pass therethrough, and a pair of extending portions 83 respectively extending downward from a pair of opposite sides of the top plate 21.

The case 2 is a box-shaped member formed of an insulating resin and opened upward. As shown in FIGS. 4 and 5, the case 2 includes a bottom plate 21, four wall portions 22 extending upward from the outer peripheral portion of the bottom plate 21, a containable portion 23 defined by the upper surface of the bottom plate 21 and the inner surfaces of the four wall portions 22, and a pair of engagement projections 24 arranged along the Y direction in the drawing and formed on each of the outer surfaces of the pair of opposite wall portions 22. The case 2 internally holds the central contact 3 and the outer contact 4 in a state of being insulated from each other.

The bottom plate 21 is a plate-like member having a substantially square planar shape, and functions as a substrate of the push switch 1. The four wall portions 22 extend upward from each side of the bottom plate 21, and are integrally formed with the bottom plate 21. The containable portion 23 is a concave portion which opens upward and is defined by the upper surface of the bottom plate 21 and the inner surfaces of the four wall portions 22. In the illustrated embodiment, the inner surface of the containable portion 23 forms a substantially square planar shape. Each component of the push switch 1 is contained in the containable portion 23. In this manner, the case 2 has a function as a housing for containing each component of the push switch 1 in the containable portion 23. The case 2 holds the central contact 3 and the outer contact 4 in a state of being insulated from each other. The case 2 is obtained by disposing the central contact 3 and the outer contact 4 in a mold having an inner shape corresponding to the shape of the case 2, injecting an insulating resin into the mold, and curing the resin.

The pair of engagement projections 24 are respectively formed on each of the outer surfaces of the pair of opposite wall portions 22 arranged along the Y direction in the drawing, and are used for locking the cover 8 with respect to the case 2. The pair of engagement projections 24 formed on the outer surface of the wall portion 22 in the +X direction in the figure and the pair of engagement projections 24 formed on the outer surface of the wall portion 22 in the −X direction in the figure are formed in the same configuration and arrangement.

As shown in FIG. 4, each of the pair of engagement projections 24 has an inclined portion 241 whose height gradually increases from the upper side to the lower side, a flat portion 242 linearly extending from a top of the inclined portion 241 to the lower side, and a guide portion 243 laterally extending from the upper end portion of the inclined portion 241. The inclined portions 241 have a function of sliding a pair of inclined portions 8321 (see FIGS. 4 and 9) formed at the respective lower ends of the pair of extending portions 83 of the cover 8 along the inclination thereof when the cover 8 is attached to the case 2 by pushing down the cover 8 against the case 2 from the upper side, thereby facilitating the pair of extending portions 83 to open outward. The upper end of each inclined portion 241 coincides with the upper edge of the outer surface of the wall portion 22 on which the engagement projections 24 are formed. Therefore, each inclined portion 241 is formed so that the height (length in the X direction in the figure from the outer surface of the wall portion 22) gradually increases downward from the upper edge of the outer surface of the wall portion 22.

The flat portions 242 of the pair of engagement projections 24 engage with the bridge portions 832 of the pair of extending portions 83 of the cover 8 (see FIGS. 4 and 9), and have a function of locking the cover 8 with respect to the case 2. Each of the flat portions 242 straight extends downward from the top of the inclined portion 241, that is, from the lower end thereof. Therefore, the height of the flat portion 242 is constant. The cover 8 is locked with respect to the case 2 by engaging the lower end surfaces of the flat portions 242 with the upper end surfaces of the bridge portions 832, respectively.

Each of the guide portions 243 is a portion that is inclined at the same angle as the inclined portion 241 and extends in the lateral direction (Y direction) from the upper end portion of the inclined portion 241. The guide portions 243 have a function of sliding the pair of inclined portions 8321 formed at the respective distal ends of the pair of extending portions 83 along the inclination of the guide portion 243 when the cover 8 is pushed down against the case 2, so that attachment of the cover 8 to the case 2 is guided. The width of each guide portion 243 in the Y direction is substantially equal to the width of each of the pair of inclined portions 8321 formed in each of the extending portions 83.

FIG. 6 shows a perspective view of the central contact 3 and the outer contact 4 (a pair of contacts) held by the case 2. Each of the central contact 3 and the outer contact 4 is formed of a conductive material, more specifically, a metallic material such as copper. The central contact 3 and the outer contact 4 are held in a state of being insulated from each other in the containable portion 23, and function as fixed electrodes.

Each of the central contact 3 and the outer contact 4 is obtained by punching and bending a single sheet of metal. The central contact 3 has a main body portion 31, a contact surface 32 which contacts with the movable contact 5, and a terminal portion 33 extending to the outside of the case 2. The contact surface 32 of the central contact 3 is exposed upward in the containable portion 23, and contacts with the movable contact 5 when the movable contact 5 is in the second position. The contact surface 32 is located above the upper surface of the main body portion 31 in the containable portion 23. The terminal portion 33 of the central contact 3 extends outward from the wall portion 22 in the +Y direction and functions as an external terminal to be connected to a circuit board or the like of the electronic device.

The outer contact 4 has a main body 41, four contact surfaces 42 in contact with the movable contact 5, and a terminal portion 43 extending to the outside of the case 2. The contact surfaces 42 are exposed upward in the containable portion 23, and are surfaces that are in contact with the movable contact 5 when the movable contact 5 is in either the first position or the second position. In the containable portion 23, the four contact surfaces 42 are located above the upper surface of the main body 41. The terminal portion 43 extends outward from the wall portion 22 in the −Y direction and functions as an external terminal to be connected to a circuit board or the like of the electronic device.

As shown in FIG. 5, a part of the main body portion 31 of the central contact 3 and the contact surface 32 are exposed upward in the containable portion 23 of the case 2, further, the central contact 3 is held by the case 2 in a state that the terminal portion 33 of the central contact 3 extends toward the outside from the wall portion 22 (+Y direction wall portion). Furthermore, a part of the main body portion 41 of the outer contact 4 and the four contact surfaces 42 of the main body portion 41 are exposed upward in the containable portion 23, and the outer contact 4 is held by the case 2 in a state that the terminal portion 43 extends toward the outside from the wall portion 22 (−Y direction wall portion). Further, in the containable portion 23, the main body portion 41 of the outer contact 4 surrounds the periphery of the main body portion 31 of the central contact 3 excepting a portion in the +Y direction in a state that the main body portion 41 is spaced apart from the main body portion 31. Further, the four contact surfaces 42 are located at the four corners of the bottom plate 21 of the containable portion 23.

Referring back to FIG. 4, the movable contact 5 is an elastically conductive member having an upwardly convex dome shape, and is disposed on the upper side of the central contact 3 and the outer contact 4 in the containable portion 23 of the case 2. The movable contact 5 has a shape that fits in the containable portion 23. In the illustrated embodiment, the movable contact 5 has a substantially circular planar shape, but as long as the shape that fits in the containable portion 23, the present disclosure is not limited thereto. For example, when the inner surface of the containable portion 23 forms a substantially non-circular planar shape such as a substantially elliptical shape or a substantially polygonal shape, the movable contact 5 may have a shape corresponding to the planar shape formed by the inner surface defined by the inner surfaces of the containable portion 23 so as to fit in the containable portion 23. The movable contact 5 is configured so as to be displaceable between a first position in which the central contact 3 and the outer contact 4 are in a non-conductive state and a second position in which the central contact 3 and the outer contact 4 are in a conductive state.

The movable contact 5 has a central movable portion 51 that contacts with the central contact 3, an outer edge portion 52 formed so as to surround the central movable portion 51, and four contact portions 53 extending outward and downward from the outer edge portion 52 so that they are in contact with the four contact surfaces 42 of the outer contact 4, respectively. As shown in the cross-sectional view of the push switch 1 of FIG. 12, the movable contact 5 is provided in the containable portion 23 of the case 2 such that the central movable portion 51 faces the contact surface 32 of the central contact 3 with a gap therebetween, and the four contact portions 53 are respectively in contact with the four contact surfaces 42. That is, in a natural state in which a pressing force is not applied to the push switch 1 by the user, the movable contact 5 is convex upward. In the natural state shown in FIG. 12, the movable contact 5 is in a first position. When the movable contact is in the first position, the movable contact 5 is not in contact with the central contact 3, while it is in contact with the outer contact 4. Therefore, when the movable contact 5 is in the first position, the central contact 3 and the outer contact 4 are in a non-conductive state.

In the natural state shown in FIG. 12, when the pressing force is applied by the user to the protrusion 72 of the cap 7, the protrusion 72 is elastically deformed downward to depress the pressing member 6 downward. Then, as shown in FIG. 13, the pressing member 6 presses the movable contact 5 downward to shift the movable contact 5 from the first position to the second position. When the movable contact 5 is in the second position, the four contact portions 53 are in contact with the four contact surfaces 42 of the outer contact 4, respectively, and the central movable portion 51 is in contact with the contact surface 32 of the central contact 3. That is, when the movable contact 5 is in the second position, the movable contact 5 is in contact with both the central contact 3 and the outer contact 4. Therefore, when the movable contact 5 is in the second position, the movable contact 5 functions as a conduction path between the central contact 3 and the outer contact 4 so that the central contact 3 and the outer contact 4 are in a conductive state. In this regard, the shape of the movable contact 5 is not necessarily limited to the dome shape as long as the movable contact 5 can be displaced between the first position in which the movable contact 5 makes the central contact 3 and the outer contact 4 in a non-conductive state and the second position in which the movable contact 5 makes the central contact 3 and the outer contact 4 in a conductive state. If so, the movable contact 5 may have any shape.

Referring back to FIG. 4, the pressing member 6 is a member formed of a hard resin material such as nylon resin. The pressing member 6 is provided on the upper side of the movable contact 5 in the containable portion 23 of the case 2. The pressing member 6 is used to effectively transmit the pressing force applied to the push switch 1 by the user to the movable contact 5 to push down the movable contact 5 downward. As shown in FIG. 4, the pressing member 6 includes a base portion 61 having a planar shape that can fit in the containable portion 23 (in the illustrated embodiment, substantially square shape), a cylindrical upper projection 62 formed so as to protrude upward substantially at the center of the upper surface side of the base portion 61, and a cylindrical lower projection 63 formed so as to protrude downward substantially at the center of the lower surface side of the base portion 61 (see FIG. 7).

As shown in FIG. 12, the upper projection 62 and the lower projection 63 are formed so as to be concentric with each other. The height of the upper projection 62 is higher than the height of the lower projection 63. Further, the diameter of the upper projection 62 is larger than the diameter of the lower projection 63. In a state that the push switch 1 is assembled, the base portion 61 is in contact with the inner surfaces of the four wall portions 22 defining the containable portion 23, and the upper projection 62 protrudes upward from the upper end of the four wall portions 22 of the case 2. Further, the lower projection 63 is in contact with the central movable portion 51 of the movable contact 5.

Referring back to FIG. 4, the cap 7 is a member formed of an elastic material such as silicon rubber. The cap 7 covers the containable portion 23 from the upper side so as to prevent dust and dirt from entering the containable portion 23, thereby providing a dust-proof function of the push switch 1. In addition, in a state that the push switch 1 is assembled, the protrusion 72 protrudes largely upward from the cover 8, so that the pressing operation on the push switch 1 by the user is facilitated.

The cap 7 has a substantially square base portion 71 to be mounted on the upper end of the four wall portions 22 of the case 2, a protrusion 72 having a shape of a truncated cone formed substantially at the center portion of the base portion 71 and protruding upward, a lower protrusion 73 (see FIG. 8) formed so as to protrude downward from a back surface of a top portion of the protrusion 72, and four positioning projections 74 formed at the four corners of the back surface of the base portion 71.

The base portion 71 of the cap 7 has a size and a planar shape so as to cover the containable portion 23 of the case 2 from the upper side, and is to be placed on the upper end of the four wall portions 22. As shown in FIG. 12, in the assembled state of the push switch 1, the base portion 71 is held in a compressed state between the upper end of the four wall portions 22 and the top plate 81 of the cover 8. The base portion 71 seals the space between the upper end of the four wall portions 22 and the top plate 81 of the cover 8, and provides a dust-proof function for preventing dust and dirt from entering the containable portion 23.

The protrusion 72 of the cap 7 is a circular truncated cone shape portion protruding upward from a substantially center portion of the base portion 71. As shown in FIG. 8, the protrusion 72 has a hollow structure. In the natural state of the push switch 1 shown in FIG. 12, the upper portion of the upper projection 62 of the pressing member 6 is located inside the protrusion 72. Further, in this state, the upper projection 62 is spaced apart from the cap 7.

As shown in FIG. 8, a lower protrusion 73 of the cap 7 is a cylindrical portion protruding downward from a back surface of a head top portion of the protrusion 72 of the cap 7. In the natural state of the push switch 1 shown in FIG. 12, the lower protrusion 73 faces the upper projection 62 of the pressing member 6. Referring back to FIG. 8, the four positioning projections 74 of the cap 7 are formed at positions corresponding to the four corners of the lower surface of the base portion 71, and protrude downward. As shown in FIG. 12, when the base portion 71 is placed on the upper end of the four wall portions 22 of the case 2, the four positioning projections 74 are respectively engaged with the four corners of the containable portion 23 of the case 2, and thus the positioning of the cap 7 is performed. Further, the four positioning projections 74 are in contact with the upper surface of the base portion 61 of the pressing member 6 to prevent vertical vibration of the pressing member 6 in the containable portion 23. Therefore, in the natural state of the push switch 1 shown in FIG. 12, the pressing member 6 is held by the movable contact 5 and the cap 7.

Since the cap 7 is formed of an elastic material, when the user of the push switch 1 applies a pressing force so as to push down the protrusion 72 of the cap 7, the protrusion 72 is elastically deformed downward. When further pressing force is applied from this state, the lower protrusion 73 of the cap 7 contacts with the upper projection 62 of the pressing member 6, and thus the pressing member 6 is pressed down, so that the central movable portion 51 of the movable contact 5 is elastically deformed downward by the lower projection 63 of the pressing member 6. As a result, as shown in FIG. 13, the central movable portion 51 is in contact with the contact surface 32 of the central contact 3, and therefore, through the movable contact 5, the central contact 3 and the outer contact 4 become a conductive state.

Referring back to FIG. 4, the cover 8 engages with the case 2 and has a function of holding the cap 7 on the case 2 by pressing the base portion 71 of the cap 7 from the upper side. The cover 8 is obtained by punching and bending a single metal plate. The cover 8 includes a top plate 81 having a substantially square planar shape, an opening 82 formed in the top plate 81 so as to allow the protrusion 72 of the cap 7 to pass therethrough, a pair of extending portions 83 extending downward from a pair of opposite sides (sides extending in the Y direction in the drawing) of the top plate 81, and four bending portions 84 extending downward from a substantially center portion of each side of the top plate 81.

The top plate 81 holds the cap 7 on the case 2 by pressing the base portion 71 of the cap 7 from the upper side in a state that the push switch 1 is assembled, and prevents the movable contact 5 and the pressing member 6 which are contained in the containable portion 23 of the case 2 and the cap 7 from being detached. The top plate 81 is a plate-shaped member having a planar shape corresponding to the base portion 71. The opening 82 is formed substantially at the center portion of the top plate 81 in order to allow the protrusion 72 of the cap 7 to protrude upward in the assembled state of the push switch 1. In the illustrated embodiment, the shape of the opening 82 is a circular shape corresponding to the shape of the protrusion 72, but may not be limited as long as the protrusion 72 can be passed therethrough.

The pair of extending portions 83 are used to lock the cover 8 with respect to the case 2. As shown in FIG. 4, the pair of extending portions 83 extend downward from opposite sides of the top plate 81, that is, the sides extending in the Y direction in the drawing. The extending portion 83 extending downward from the side in the +X direction of the top plate 81 and the extending portion 83 extending downward from the side in the −X direction of the top plate 81 are formed in the same configuration and the same arrangement. FIG. 9 is a view of the cover 8 seen from the X direction. As shown in FIG. 9, each of the extending portions 83 has a pair of leg portions 831 extending downward from the side of the top plate 81, and a bridge portion 832 connecting the lower end portions of the leg portions 831.

The pair of leg portions 831 linearly extend downward from both ends of the side of the top plate 81, that is from the both ends in the Y direction. For instance, the outer side surfaces of the pair of leg portions 831 respectively extend linearly downward from the both ends of the side of the top plate 81. Therefore, the distance between the outer side surfaces of the pair of leg portions 831 is equal to the length of the side of the top plate 81. In the push switch 1 of the present disclosure, the pair of leg portions 831 are formed as far apart from each other as possible in the left and right (Y direction). When the cover 8 is locked with respect to the case 2, the inner side surfaces of the pair of leg portions 831 and the outer side surfaces of the pair of engagement projections 24 formed on the outer side surface of the wall portion 22 of the case 2 are in contact with each other, respectively, whereby swinging of the cover 8 in the Y direction and inclination of the cover 8 with respect to the case 2 are suppressed.

In the conventional push switch 500 described in the section of the background art, the number of the engagement projection 514 formed on the outer surface of each of the opposite wall portions 512 of the case 510 is one, and the formation position of the engagement projection 514 is substantially in the vicinity of the center of the outer surface of each of the opposite wall portions 512. Therefore, when the cover 560 is locked with respect to the case 510, the inner side surfaces of each of the extending portions 563 of the cover 560 come into contact with the outer side surfaces of the engagement projection 514 at a position near the center of each of the outer side surfaces of the opposite wall portions 512 of the case 510. As described above, when the inner side surfaces of each of the extending portions 563 of the cover 560 come into contact with the outer side surfaces of the engagement projection 514 at the positions near the center of the respective outer side surfaces of the opposite wall portions 512 of the case 510, the effect of suppressing the inclination of the cover 8 with respect to the case 2 is low, and thus the attachment state of the cover 560 with respect to the case 510 is not stable. Therefore, in order to improve the effect of suppressing the inclination of the cover 8 with respect to the case 2, in the push switch 1 of the present disclosure, a pair of engagement projections 24 are formed to be separated from each other in the vicinity of both end portions of the outer surface of each of the opposite wall portions 22 of the case 2. With such a configuration, when the cover 8 is locked with respect to the case 2, the inner side surfaces of the leg portions 831 of the cover 8 and the outer side surfaces of the pair of engagement projections 24 are in contact with each other at two positions near both ends on the outer side surface of each of the opposite wall portions 22 of the case 2, so that the inclination of the cover 8 with respect to the case 2 is suppressed more effectively, and the state of attachment of the cover 8 to the case 2 becomes more stable.

Further, in the effect of suppressing the inclination of the cover 8 with respect to the case 2, it may be that a contact position between the inner side surface of one of the leg portions 831 and the outer side surface of the corresponding engagement projection 24 and a contact position between the inner side surface of the other leg portion 831 and the outer side surface of the corresponding engagement projection 24 are spaced apart from each other in the lateral direction (Y direction) as far as possible. This is because, when the cover 8 is inclined with respect to the case 2, the amount of changes of the position of the cover 8 with respect to the case 2 increases as the position of the cover 8 is far away from a center of the case 2 in the Y direction. By making the inner side surfaces of the leg portions 831 and the outer side surfaces of the engagement projections 24 formed on the outer side surface of each of the opposite wall portions 22 of the case 2 come into contact with each other at a position far away from the center in the Y direction where the amount of the changes of the position of the cover 8 with respect to the case 2 would be large, it is possible to more effectively suppress the inclination of the cover 8 with respect to the case 2.

Examples in which the cover 8 is inclined with respect to the case 2 include a case in which the user presses a portion outside the center of the protrusion 72 of the cap 7 when performing a pressing operation with respect to the push switch 1. The cap 7 is made of an elastic material, so that in this case the part of the cap 7 on the side pressed down by the user sinks downward while the opposite part of the cap 7 rises upward. As a result, the cover 8 holding the cap 7 on the case 2 is inclined with respect to the case 2 according to the deformation of the cap 7. In the push switch 1 of the present disclosure, the pair of leg portions 831 are formed as far apart from each other as possible in the left and right (Y direction). Therefore, the contact position between the inner side surface of one of the leg portions 831 and the outer side surface of the corresponding engagement projection 24 and the contact position between the inner side surface of the other leg portion 831 and the outer side surface of the corresponding engagement projection 24 are largely separated from each other, thereby improving the effect of suppressing the inclination of the cover 8 with respect to the case 2 as described above.

Each of the pair of leg portions 831 has a straight portion 8311 whose outer side surface and inner side surface linearly extend downward, and a reduced width portion 8312 whose outer side surface linearly extends downward and whose inner side surface is inclined toward the outer side surface thereof. As described above, from the viewpoint of improving the effect of suppressing the inclination of the cover 8 with respect to the case 2, it may be that the contact position between the inner side surface of one of the leg potions 831 and the outer side surface of the corresponding engagement projection 24 and the contact position between the inner side surface of the other leg portion 831 and the outer side surface of the corresponding engagement projection 24 be largely separated from each other, and therefore, the width (length in the Y direction) of the straight portion 8311 is set as small as possible within a range in which the strength of the leg portion 831 is not lowered over necessity. As described above, in the illustrated embodiment shown in FIG. 11, since the top plate 81 has a substantially square planar shape and the opening 82 has a circular shape, the distance from the edge of the opening 82 to each side of the top plate 81 is minimized at the center of the side. In the illustrated embodiment, the width of the straight portion 8311 is smaller than the smallest distance Dmin (see FIG. 11) from the edge of the opening 82 to the side of the top plate 81 at the center of each of the sides of the top plate 81 on which the extending portions 83 are respectively formed.

Referring back to FIG. 9, in each of the pair of extending portions 83, the reduced width portion 8312 is a position which extends downward from the straight portion 8311 and is connected to the bridge portion 832. The width of the reduced width portion 8312 gradually decreases from the upper side to the lower side, and the width becomes minimum at the connection portion with the bridge portion 832. The reduced width portion 8312 is formed to prevent the connecting portion between each of the leg portions 831 and the bridge portion 832 from interfering with the pair of engagement projections 24 formed on the outer side surface of each of the opposite wall portions 22 of the case 2 when the cover 8 is locked with respect to the case 2.

When manufacturing the cover 8, in order to form the extending portions 83, it is necessary to perform punching on a metal plate. As is well known, when punching is performed on a metal plate, the corners of the punched portion are not an accurate right angle, and it becomes rounded. If each of the leg portions 831 does not have the reduced width portion 8312, the connecting portion between each leg portion 831 and the bridge portion 832 is not at a right angle, and it becomes rounded. In this case, when the cover 8 is locked with respect to the case 2, the roundness of the connecting portions between each of the leg portions 831 and the bridge portion 832 will interfere with the pair of engagement projections 24 formed on the outer surface of each of the opposite wall portions 22 of the case 2, and thus the cover 8 can not be accurately locked against the case 2. On the other hand, in the push switch 1 of the present disclosure, since each of the leg portions 831 has a reduced width portion 8312, the connecting portion between each of the leg portions 831 (reduced width portion 8312) and the bridge portion 832 is located outside the inner side surface of the straight portion 8311. Therefore, when the cover 8 is locked with respect to the case 2, the roundness of the connecting portions between each of the leg portions 831 (reduced width portion 8312) and the bridge portion 832 do not interfere with the pair of engagement projections 24 formed on the outer surface of the opposite wall portion 22 of the case 2.

In each of the pair of extending portions 83, the bridge portion 832 connects the lower end portions of the pair of leg portions 831. The cover 8 is locked with respect to the case 2 by the engagement between the lower end surfaces of the flat portions 242 of the pair of engagement projections 24 formed on the outer surface of the opposite wall portion 22 of the case 2 and the upper end surface of the bridge portion 832. Each bridge portion 832 has a pair of inclined portions 8321 formed at the lower end portion of the bridge portion 832 and inclined outward, a cutout portion 8322 formed between the pair of inclined portions 8321, and an upwardly extending portion 8323 located above the cutout portion 8322 and extending upward.

The pair of inclined portions 8321 are separated from each other via the cutout portion 8322, and extend obliquely downward (outward) from both ends (both ends in the Y direction) of the bridge portion 832. The inclination of each of the pair of inclined portions 8321 is substantially equal to the inclination of each of the inclined portions 241 of the pair of engagement projections 24 formed on the outer surface of each of the opposite wall portions 22 of the case 2. Therefore, when the cover 8 is pushed down onto the case 2 from the upper side, the pair of inclined portions 8321 slide on the inclined portions 241 of the pair of engagement projections 24, respectively, and thus each of the extending portions 83 opens outward. Therefore, the pair of inclined portions 8321 have a function of facilitating attachment of the cover 8 to the case 2 when assembling the push switch 1.

Figure 2:
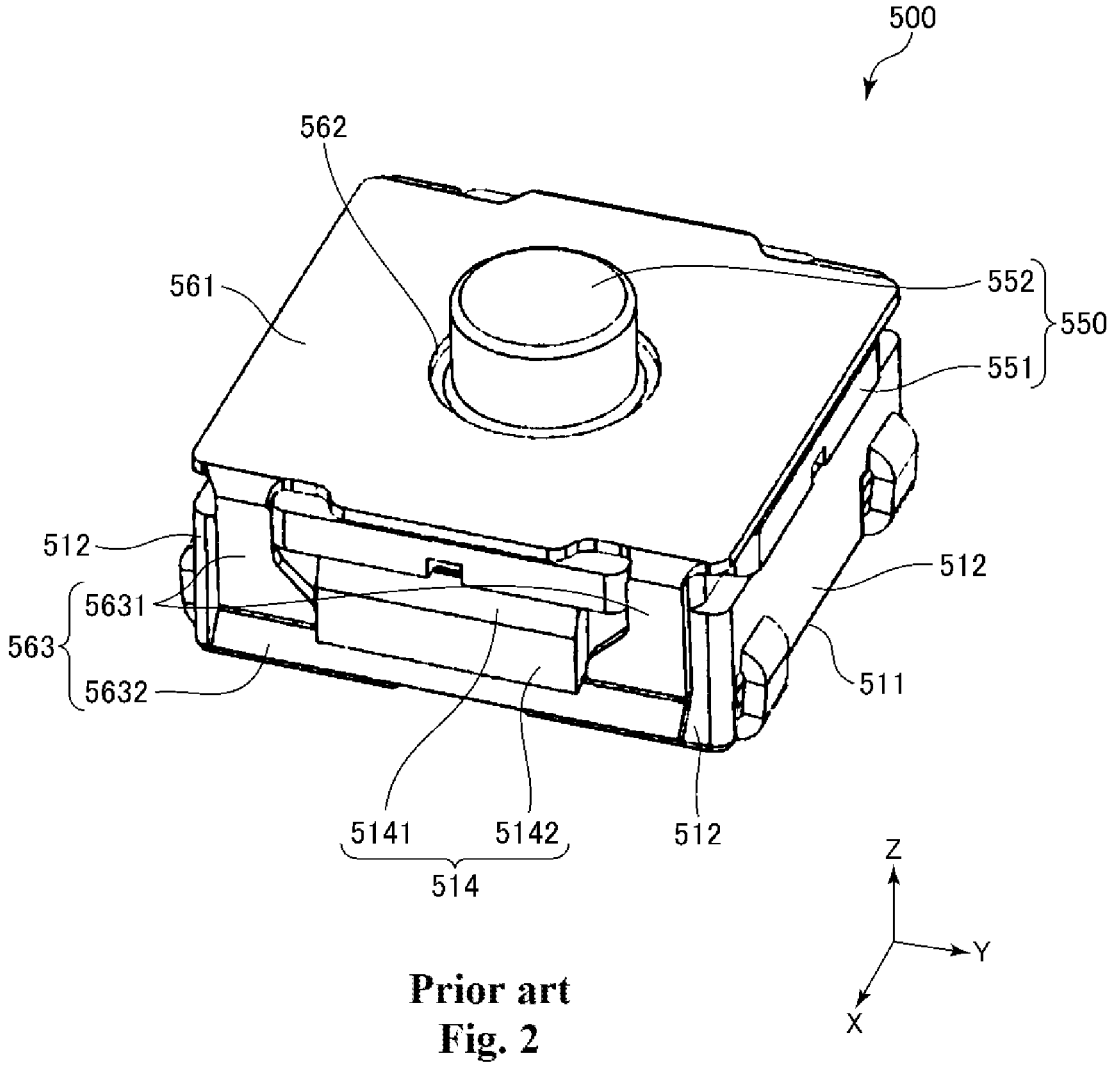
Prior art Fig. 2
FIG. 2 is a perspective view of the prior art push switch shown in FIG. 1.

The pair of inclined portions 8321 are formed by bending the lower end portion of the bridge portion 832 outward. As discussed in the section of the background art, bending of small metal pieces such as bridge portions 832 is very difficult. For instance, the greater the width of the portion to be subjected to the bending process, the higher the degree of difficulty of the bending process. On the other hand, since each of the inclined portions 8321 is a portion that slides on the inclined portion 241 and the guide portion 243 of the engagement protrusion 24, it is sufficient that the inclined portion 8321 is formed only in a portion that comes into contact with the inclined portion 241 and the guide portion 243 of the engagement protrusion 24 when the cover 8 is attached to the case 2. Therefore, in the push switch 1 of the present disclosure, the cutout portion 8322 is formed in the lower portion substantially at the center of the bridge portion 832, and thus, the inclined portions 8321 are formed only at portions in contact with the inclined portions 241 and the guide portions 243 of the engagement protrusions 24 when the cover 8 is attached to the case 2. As described above, by forming the cutout portion 8322 on the lower side of the substantially center portion of the bridge portion 832, the portions where the bending process are to be performed and the inclined portions 8321 are to be formed are limited to only the both ends of the lower end portion of the bridge portion 832. Therefore, as compared with the case where the bending process is performed on the entire lower end portion of the bridge portion 832, the width of the portion to be subjected to the bending process is greatly reduced. Therefore, as compared with the case where the bending process is performed on the whole of the bridge portion 832 ("5632" in the prior art shown in FIGS. 1 and 2) or the whole of the lower end portion of the bridge portion 832 ("5632" in the prior art shown in FIGS. 1 and 2) as in the prior art, the degree of difficulty of the bending process for forming the inclined portions 8321 can be greatly reduced, and thus the yield of manufacturing of the cover 8 can be improved. As a result, the manufacturing cost of the push switch 1 can be reduced.

In each of the extending portions 83, a cutout portion 8322 is formed between the pair of inclined portions 8321. The cut-out portion 8322 can be formed by punching a lower portion of the bridge portion 832 substantially at the center thereof. The width and shape of the cutout portion 8322 are appropriately set in accordance with the required size and position of the pair of inclined portions 8321 to be formed at both ends of the bridge portion 832. The upwardly extending portion 8323 is a portion which is located on the upper side of the cutout portion 8322, and is located between the pair of leg portions 831, and extends toward the upper side while being separated from the pair of leg portions 831. The upwardly extending portion 8323 is formed to reinforce the strength of the portion where the cutout portion 8322 is formed. Therefore, the upwardly extending portion 8323 has a shape corresponding to the shape of the cutout portion 8322. Since each of the extending portions 83 has the cutout portion 8322 and the upwardly extending portion 8323, as shown in FIG. 9, the overall shape of each extending portion 83 is an inverted M-shape when viewed from the X direction.

The four bent portions 84 extend downward from substantially the center portions of the respective sides of the top plate 81. The four bent portions 84 are provided to compensate for a decrease in strength of the top plate 81 due to the formation of the opening 82 in the top plate 81. By forming the opening 82 in the top plate 81, the distance from each side of the top plate 81 to the edge of the opening 82 is shortened in the vicinity of the center of each side of the top plate 81, and thus the strength of the top plate 81 in the vicinity of the center of each side of the top plate 81 is lowered. For example, as shown in FIG. 11, the distance from the side of the top plate 81 to the edge of the opening 82 is minimum (minimum distance Dmin) at the center of each side of the top plate 81, and the strength of the top plate 81 near the center of each side of the top plate 81 is lowered.

The strength of the top plate 81 is compensated by providing the bent portions 84 extending downward in the vicinity of the center of each side of the top plate 81 where strength is greatly lowered. As shown in FIG. 9, the bent portion 84 extending downward from the substantially center of the side on which each extending portion 83 is formed is located between the pair of leg portions 831 of the extending portion 83. The bent portion 84 is separated from the pair of leg portions 831 of the extending portion 83 and the upwardly extending portion 8323 of the bridge portion 832.

The push switch 1 including the above-described components is assembled by the following procedure. First, the movable contact 5 and the pressing member 6 are placed in the containable portion 23 of the case 2, and then the base portion 71 of the cap 7 is placed on the upper end of the four wall portions 22 of the case 2. Thereafter, the cover 8 is pressed down against the case 2 from the upper side so that the protrusion 72 of the cap 7 is inserted into the opening 82 of the cover 8 from the lower side. At this time, each inclined portion 8321 of the pair of extending portions 83 of the cover 8 slides on the inclined portion 241 and the guide portion 243 of each of the engagement projections 24 formed on the outer surfaces of each of the opposite wall portions 22 of the case 2, and thereby the pair of extending portions 83 open outward easily. When each of the pair of extending portions 83 exceeds the flat portion 242 of each of the engagement projections 24 formed on the outer surfaces of the opposite wall portions 22 of the case 2, the lower end surface of the flat portion 242 of each of the engagement projections 24 engages with the upper end surface of the bridge portion 832 of each of the extending portions 83, the cover 8 is locked with respect to the case 2, and thus the push switch 1 is assembled. In this state, the base portion 71 of the cap 7 is held in a compressed state between the top plate 81 of the cover 8 and the upper end of the four wall portions 22 of the case 2.

A side view and a top view of the push switch 1 in a state that the push switch 1 is assembled are shown in FIGS. 10 and 11. As shown in FIG. 10, since the lower end surfaces of the flat portions 242 of the engagement projections 24 and the upper end surface of the bridge portion 832 of each of the extending portions 83 are engaged, the cover 8 is locked with respect to the case 2. Furthermore, the outer side surface of the inclined portion 241 of each of the engagement projections 24 is in contact with the inner side surface of the straight portion 8311 of the leg portion 831 of each extending portion 83, thereby the lateral swing of the cover 8 and the inclination of the cover 8 with respect to the case 2 are suppressed. As shown, in a state where the cover 8 is locked with respect to the case 2, the upwardly extending portions 8323 of the cover 8 are spaced apart from the pair of engagement projections 24 of the case 2. Therefore, the pair of engagement projections 24 of the case 2 are held between the pair of leg portions 831 of each extending portion 83 of the cover 8 and the upwardly extending portion 8323 of each bridge portion 832.

The pair of inclined portions 8321 of the bridge portion 832 of each extending portion 83 are respectively located below the pair of engagement projection 24. Further, the pair of inclined portions 8321 are separated from each other by the cutout portion 8322. As described above, in the push switch 1 of the present disclosure, the pair of inclined portions 8321 are formed only at both ends of the lower end portion of the bridge portion 832. Therefore, the degree of difficulty of the bending process for forming the inclined portions 8321 are greatly reduced as compared with the case where the bending process is performed on the entire bridge portion 832 (5632 in the prior art shown in FIGS. 1 and 2) or the entire lower end portion of the bridge portion 832 (5632 in the prior art shown in FIGS. 1 and 2) in each of the extending portions 563.

As described above, when the user presses a portion other than the center of the protrusion 72 of the cap 7, the portion on the side pressed by the user sinks downward, while the portion on the opposite side of the cap 7 rises upward, so that the cover 8 tilts with respect to the case 2. In the push switch 1 of the present disclosure, as shown in FIG. 11 which is a planar view, the outer side surfaces of the engagement projections 24 formed on the outer side surfaces of the pair of opposite wall portions 22 of the case 2 are located outside the opening 82 formed in the top plate 81 of the cover 8. In other words, the distance SD between the outer side surfaces of the pair of engagement projections 24 is larger than the diameter of the opening 82 formed substantially at the center of the top plate 81. Therefore, regardless of whether the user presses any portion of the protrusion 72 of the cap 7, the center of inclination of the cover 8 with respect to the case 2 is positioned between the contact position of the inner side surface of one of the pair of leg portions 831 and the outer side surface of one of the pair of engagement projections 24 and the contact position of the inner side surface of the other of the pair of leg portions 831 and the outer side surface of the other of the pair of engagement projections 24. Therefore, it is possible to more reliably suppress the inclination of the cover 8 with respect to the case 2.

Next, the operation of the push switch 1 will be described in detail with reference to FIGS. 12 and 13. FIG. 12 shows a longitudinal cross-sectional view of the push switch 1 taken along line A-A of FIG. 3 in a natural state in which no pressing force is applied to the push switch 1, and FIG. 13 shows a longitudinal cross-sectional view of the push switch 1 taken along line A-A of FIG. 3 in a pressed state in which a pressing force exceeding the operating force of the push switch 1 is applied to the push switch 1.

As shown in FIG. 12, in the natural state of the push switch 1, the movable contact 5 is convex upward. In the state shown in FIG. 12, the movable contact 5 takes the first position. In the first position, the four contact portions 53 of the movable contact 5 are in contact with the four contact surfaces 42 of the outer contact 4, respectively, but the central movable portion 51 of the movable contact 5 is not in contact with the contact surface 32 of the central contact 3. That is, the movable contact 5 is not in contact with the central contact 3 when it is in the first position, but is in contact with the outer contact 4. Therefore, when the movable contact 5 is in the first position, the central contact 3 and the outer contact 4 are in a non-conductive state.

In the natural state shown in FIG. 12, when the pressing force is applied by the user to the protrusion 72 of the cap 7, the protrusion 72 of the cap 7 is elastically deformed downward. From this state, when further pressing force is applied, the lower protrusion 73 of the cap 7 is in contact with the upper projection 62 of the pressing member 6, and thus the pressing member 6 is pressed down, thereby the lower projection 63 of the pressing member 6 elastically deforms the central movable portion 51 of the movable contact 5 downward. As a result, the movable contact 5 is displaced to the second position, so that the push switch 1 is shifted to the depressed state shown in FIG. 13.

In the depressed state shown in FIG. 13, the movable contact 5 takes the second position. In the second position, the four contact portions 53 of the movable contact 5 are in contact with the four contact surfaces 42 of the outer contact 4, respectively, and the central movable portion 51 of the movable contact 5 is in contact with the contact surface 32 of the central contact 3. That is, the movable contact 5 is in contact with both the central contact 3 and the outer contact 4 at the second position. Therefore, when the movable contact 5 is in the second position, the movable contact 5 functions as a conduction path between the central contact 3 and the outer contact 4, and thus the central contact 3 and the outer contact 4 are in a conductive state. When the pressing force on the protrusion 72 of the cap 7 is released in the depressed state shown in FIG. 13, the push switch 1 is restored to the natural state shown in FIG. 12 by the restoring force of the push switch 1 provided by the elastic restoring force of the movable contact 5.

Although the push switch of the present disclosure has been described above with reference to the illustrated embodiment, the present disclosure is not limited thereto. Each configuration of the present disclosure can be replaced with any configuration capable of performing the same function, or any configuration can be added to each configuration of the present disclosure.

Those skilled in the field and art to which this disclosure belongs will be able to make changes to the described push switch configuration of the present disclosure without significantly departing from the principles, concepts, and scope of this disclosure, and push switches having changed configurations are also within the scope of this disclosure.

In addition, the number and types of components of the push switch shown in FIGS. 3 to 12 are merely illustrative examples, and the present disclosure is not necessarily limited thereto. Also any embodiments in which any components are added or combined or any components are deleted without departing from the principles and intent of the present disclosure are also involved in the scope of the present disclosure.

Figure 14:
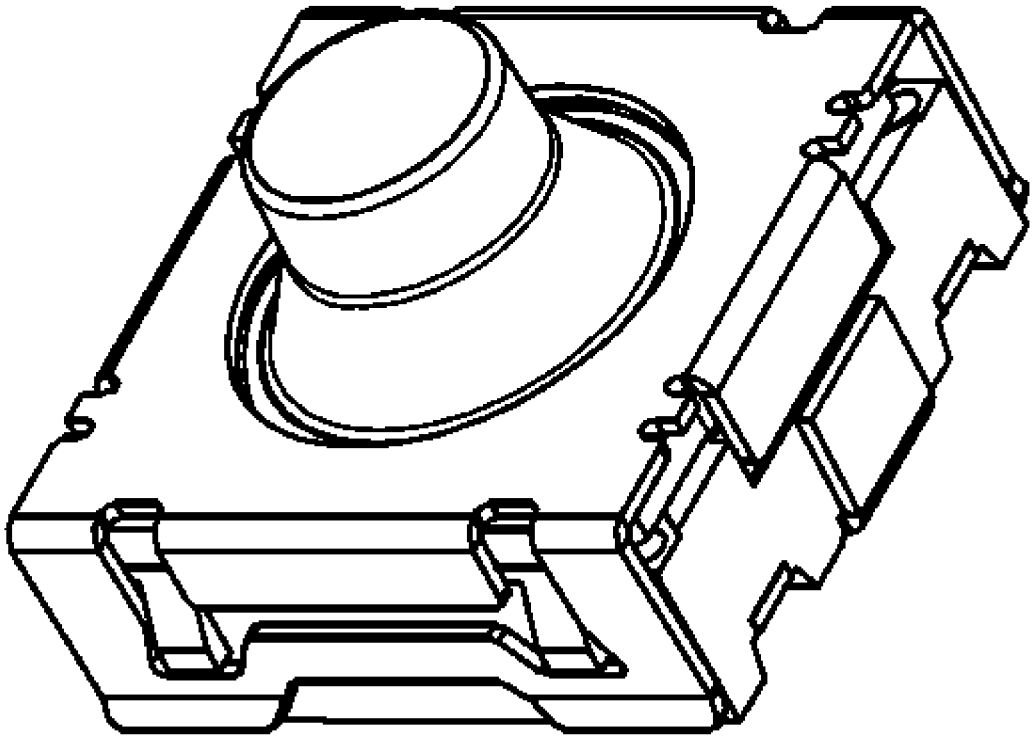
FIG. 14 is a perspective view of the push switch according to the present disclosure.
Figure 15:
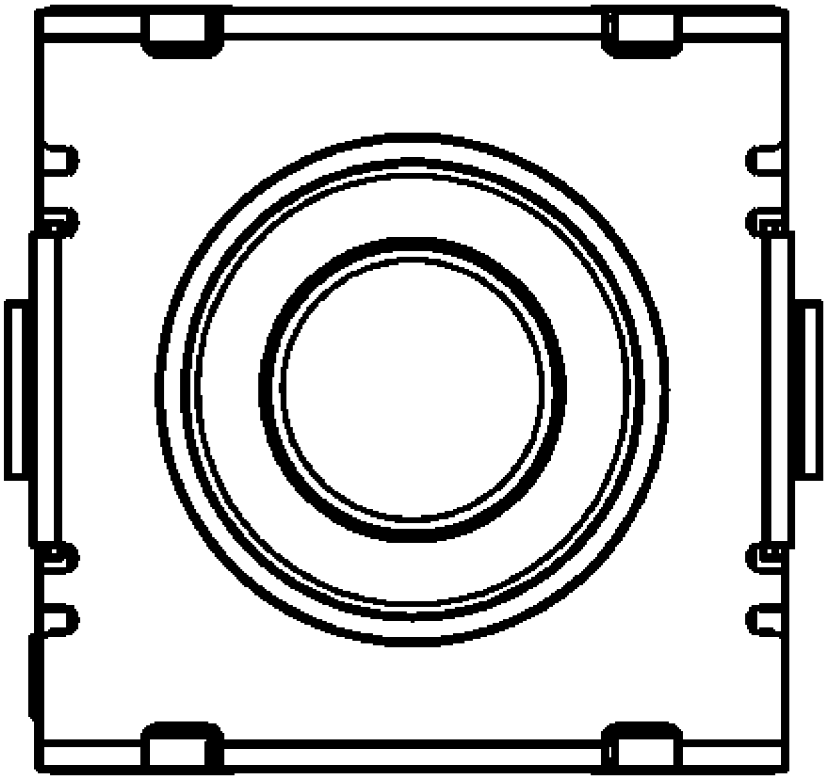
FIG. 15 is a planar view of the push switch according to the present disclosure.
Figure 16:
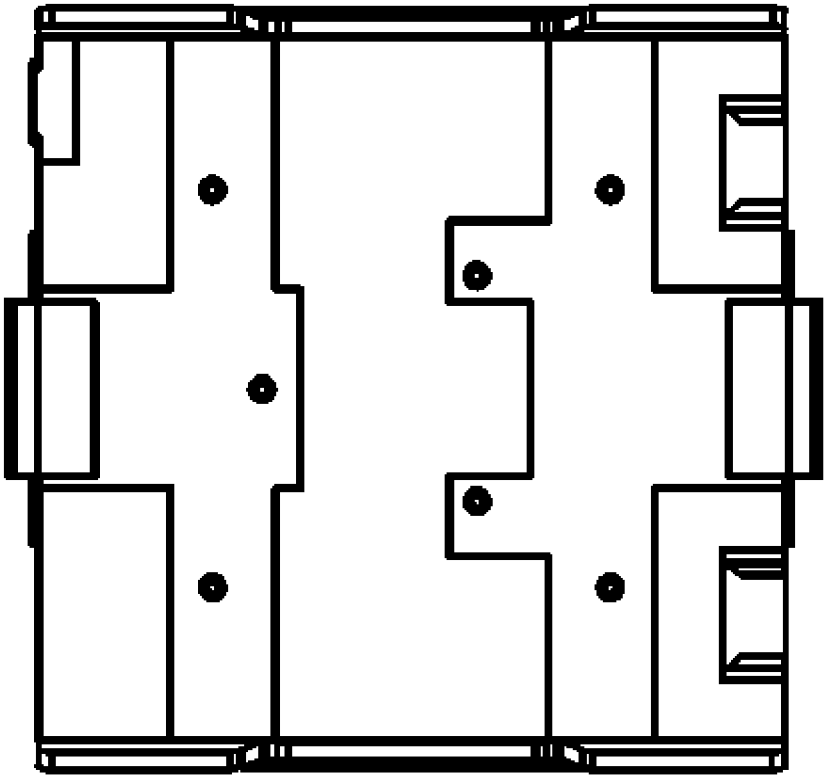
FIG. 16 is a bottom view of the push switch according to the present disclosure.
Figure 17:
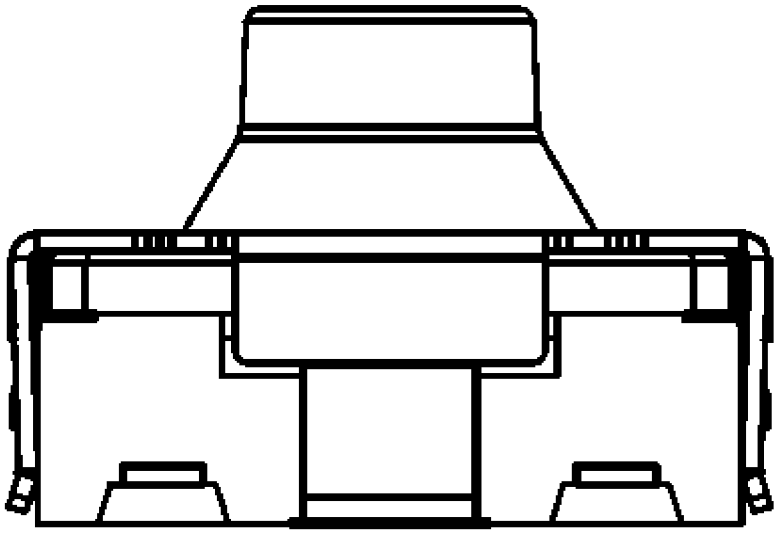
FIG. 17 is a front view of the push switch according to the present disclosure.
Figure 18:
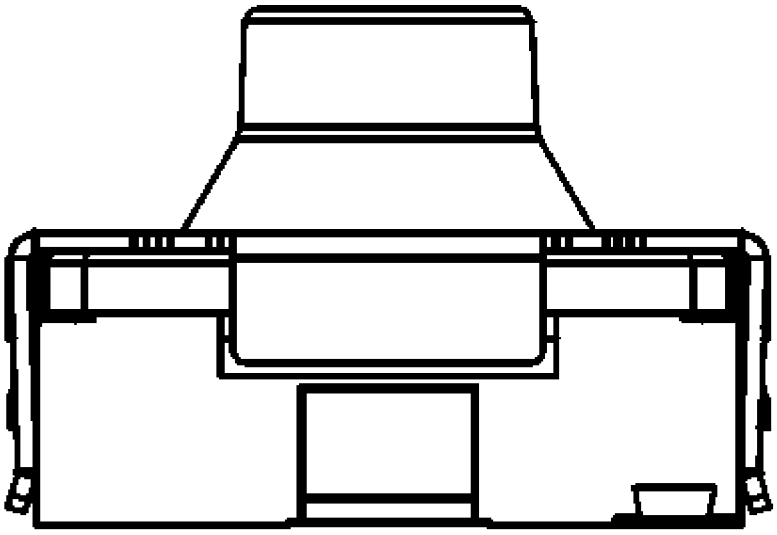
FIG. 18 is a rear view of the push switch according to the present disclosure.
Figure 19:
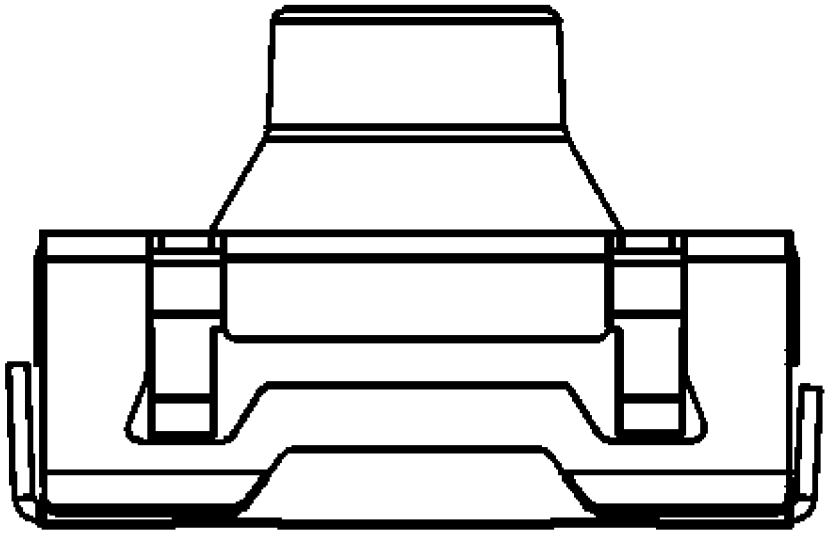
FIG. 19 is a left side view of the push switch according to the present disclosure.
Figure 20:
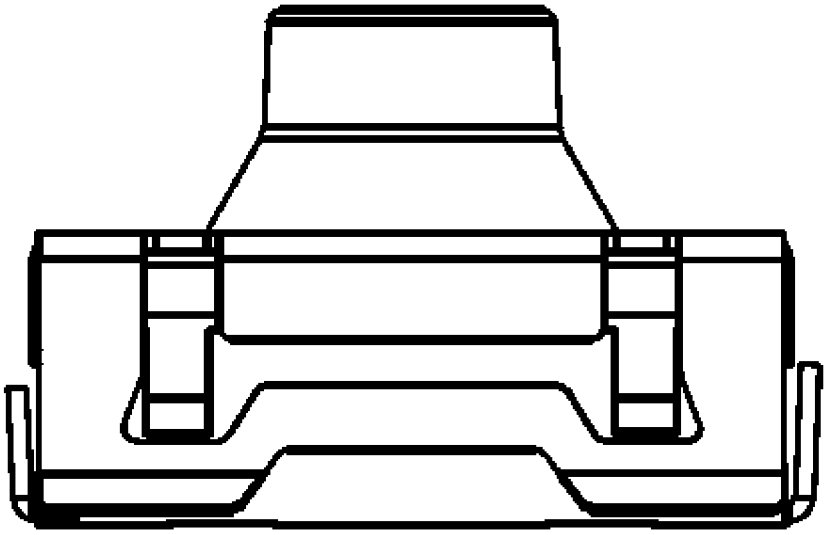
FIG. 20 is a right side view of the push switch according to the present disclosure.

Also, for the purpose of reference, precise perspective view and six-sided views of the push switch of the present disclosure are shown in FIGS. 14-20. FIG. 14 is a perspective view of the push switch according to the present disclosure. FIG. 15 is a planar view of the push switch according to the present disclosure. FIG. 16 is a bottom view of the push switch according to the present disclosure. FIG. 17 is a front view of the push switch according to the present disclosure. FIG. 18 is a rear view of the push switch according to the present disclosure. FIG. 19 is a left side view of the push switch according to the present disclosure. FIG. 20 is a right side view of the push switch according to the present disclosure.

The invention claimed is:

1. A push switch, comprising:

a case having a containable portion defined by a bottom plate and a plurality of wall portions extending from the bottom plate upwardly;

a pair of contacts spaced apart from each other on the bottom plate in the containable portion;

a movable contact disposed above the pair of contacts in the containable portion and displaceable between a first position in which the pair of contacts are in a non-conductive state and a second position in which the pair of contacts are in a conductive state;

a cap covering the containable portion of the case from an upper side thereof and including a flat plate-like base portion placed on an upper end of the plurality of wall portions of the case and a protrusion protruding from the base portion toward the upper side thereof; and a cover engaging with the case for holding the cap on the case, the cover including:

a top plate having a generally square planar shape, an opening formed in the top plate to allow the protrusion of the cap to pass therethrough, and a pair of extending portions respectively extending from opposite sides of the top plate toward a lower side, wherein the case includes a pair of engagement projections respectively formed on outer surfaces of a pair of opposite wall portions among the plurality of wall portions, wherein each of the pair of extending portions of the cover has a pair of leg portions extending from a side of the top plate toward the lower side and a bridge portion connecting the pair of leg portions, wherein each bridge portion has a pair of inclined portions formed on a lower end portion of the bridge portion and inclined outward and a cutout portion formed between the pair of inclined portions, and wherein the cover is locked with respect to the case and holds the cap on the case when the pair of engagement projections respectively formed on the pair of opposite wall portions of the case are engaged with the bridge portions of the pair of extending portions of the cover.

2. The push switch as claimed in claim 1, wherein the pair of inclined portions are located below the pair of engagement projections, respectively.

3. The push switch as claimed in claim 1, wherein the pair of inclined portions are separated from each other by the cutout portion.

4. The push switch as claimed in claim 1, wherein each of the bridge portion further includes an upwardly extending portion located on the upper side of the cutout portion, the upwardly extending portion being located between the pair of leg portions, and the pair of engagement projections are respectively held between the pair of leg portions and the upwardly extending portion of the bridge portion.

5. The push switch as claimed in claim 4, wherein the upwardly extending portion has a shape corresponding to the shape of the cutout portion.

6. The push switch as claimed in claim 1, wherein the pair of leg portions linearly extend downward from both end portions of the side of the top plate, and a distance between outer side surfaces of the pair of leg portions coincides with a length of the side of the top plate.

7. The push switch as claimed in claim 6, wherein each of the pair of leg portions has a straight portion in which an outer side surface and an inner side surface linearly extend downward and a reduced width portion in which the outer side surface linearly extends downward and an inner side surface inclines toward the outer side surface thereof, and the reduced width portion of each of the pair of leg portions is connected to the bridge portion.

8. The push switch as claimed in claim 7, wherein the outer side surfaces of the pair of engagement projections are in contact with the inner side surfaces of the pair of leg portions of each extending portion of the cover, respectively.

9. The push switch as claimed in claim 6, wherein the outer side surfaces of the pair of engagement projections are located outside an opening of the cover in a planar view.

10. The push switch as claimed in claim 1, wherein the cover further includes a bending portion extending downward from a portion between the pair of leg portions, and the bending portion is separated from the pair of leg portions and the bridge portion.

* * * * *